US007972248B2

(12) United States Patent
Liao et al.

(10) Patent No.: US 7,972,248 B2
(45) **Date of Patent: *Jul. 5, 2011**

(54) STATIONARY EXERCISE APPARATUS

(75) Inventors: Hung-Mao Liao, Taichung (TW); Mark Kannel, Oconomowoc, WI (US)

(73) Assignee: Johnson Health Tech. Co., Ltd. (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/799,595

(22) Filed: Apr. 28, 2010

(65) Prior Publication Data

US 2010/0216606 A1 Aug. 26, 2010

Related U.S. Application Data

(63) Continuation of application No. 12/011,915, filed on Jan. 30, 2008, now Pat. No. 7,744,508, which is a continuation-in-part of application No. 11/434,541, filed on May 15, 2006, now Pat. No. 7,682,290.

(30) Foreign Application Priority Data

Jun. 22, 2007 (CN) ..... 2007 1 0106184

(51) Int. Cl.
*A63B 22/04* (2006.01)
*A63B 69/16* (2006.01)

(52) U.S. Cl. ..... 482/52; 482/51

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 5,383,829 | A * | 1/1995 | Miller | 482/57 |
| 5,540,637 | A * | 7/1996 | Rodgers, Jr. | 482/52 |
| 5,573,480 | A * | 11/1996 | Rodgers, Jr. | 482/57 |
| 5,685,804 | A * | 11/1997 | Whan-Tong et al. | 482/51 |
| 5,788,609 | A * | 8/1998 | Miller | 482/51 |
| 5,813,949 | A * | 9/1998 | Rodgers, Jr. | 482/70 |
| 5,893,820 | A * | 4/1999 | Maresh et al. | 482/51 |
| 5,910,072 | A | 6/1999 | Rawls et al. | |
| 5,916,065 | A * | 6/1999 | McBride et al. | 482/57 |
| 5,924,962 | A * | 7/1999 | Rodgers, Jr. | 482/57 |

(Continued)

FOREIGN PATENT DOCUMENTS

CN 2559371 Y 7/2003

(Continued)

OTHER PUBLICATIONS

English language Abstract of CN2559371Y, European Patent Office's esp@cenet.com database, 1p.

(Continued)

*Primary Examiner* — Steve R Crow
(74) *Attorney, Agent, or Firm* — Smith Law Office

(57) ABSTRACT

A stationary exercise device with a frame including a base, a front portion, and a back portion, a rail joined to the front portion and back portion including a portion of the rail that is spaced apart from and above the base, first and second supporting members linked to the frame to rotate about a first axis, first and second swing member connected to the rail to pivot about a swing axis, first and second control links pivotally connected to the first and second control members, and first and second pedals respectively connected to the first and second control links.

13 Claims, 23 Drawing Sheets

U.S. PATENT DOCUMENTS

| | | | | |
|---|---|---|---|---|
| 5,938,567 | A * | 8/1999 | Rodgers, Jr. | 482/51 |
| 6,004,244 | A * | 12/1999 | Simonson | 482/52 |
| 6,126,573 | A * | 10/2000 | Eschenbach | 482/51 |
| 6,135,926 | A * | 10/2000 | Lee | 482/57 |
| 6,146,313 | A * | 11/2000 | Whan-Tong et al. | 482/51 |
| 6,168,552 | B1 * | 1/2001 | Eschenbach | 482/52 |
| 6,341,476 | B2 | 1/2002 | Golightly | |
| 6,422,977 | B1 * | 7/2002 | Eschenbach | 482/52 |
| 6,440,042 | B2 * | 8/2002 | Eschenbach | 482/52 |
| 6,565,486 | B2 * | 5/2003 | Stearns et al. | 482/52 |
| 7,169,087 | B2 | 1/2007 | Ercanbrack et al. | |
| 7,267,683 | B2 * | 9/2007 | Sharkey et al. | 607/96 |
| 7,278,955 | B2 | 10/2007 | Giannelli et al. | |
| 7,316,633 | B2 * | 1/2008 | Liao et al. | 482/52 |
| 7,438,671 | B2 * | 10/2008 | Wang | 482/52 |
| 7,462,134 | B2 * | 12/2008 | Lull et al. | 482/52 |
| 7,582,043 | B2 | 9/2009 | Liao et al. | |
| 7,682,290 | B2 * | 3/2010 | Liao et al. | 482/52 |
| 7,744,508 | B2 | 6/2010 | Liao et al. | |
| 2004/0209741 | A1 | 10/2004 | Kuo | |
| 2006/0040794 | A1 * | 2/2006 | Giannelli et al. | 482/51 |
| 2007/0060449 | A1 * | 3/2007 | Lo | 482/52 |
| 2007/0099763 | A1 * | 5/2007 | Wang | 482/52 |
| 2008/0287264 | A1 * | 11/2008 | Chen | 482/52 |
| 2009/0005222 | A1 * | 1/2009 | Liao et al. | 482/52 |
| 2009/0062081 | A1 * | 3/2009 | Liao et al. | 482/52 |
| 2010/0137111 | A1 * | 6/2010 | Van Handel et al. | 482/52 |

FOREIGN PATENT DOCUMENTS

| | | | |
|---|---|---|---|
| CN | 2571426 | Y | 9/2003 |

OTHER PUBLICATIONS

English language Abstract of CN2571426Y, European Patent Office's esp@cenet.com database, 1p.

Form PCT/ISA/220, Notification of Transmittal of the Int'l Search Report and the Written Opinion of the Int'l Searching Authority or the Decl. rec'd Dec. 10, 2007, 3pp.

Form PCT/ISA/210, International Search Report received Dec. 10, 2007, 5pp.

Form PCT/ISA/237, Written Opinion of the International Searching Authority received Dec. 10, 2007, 6pp.

Form PCT/IB/326, Notification Concerning Transmittal of International Preliminary Report on Patentability received May 29, 2008, 1p.

Form PCT/IB/373, International Preliminary Report on Patentability received May 29, 2008, 1 p.

Form PCT/ISA/237, Written Opinion of the International Searching Authority received May 29, 2008, 6pp.

* cited by examiner

STATIONARY EXERCISE APPARATUS

CROSS-REFERENCE TO RELATED APPLICATION

This is a continuation of U.S. patent application Ser. No. 12/011,915 filed Jan. 30, 2008, now U.S. Pat. No. 7,744,508, which is a continuation-in-part of U.S. patent application Ser. No. 11/434,541, filed May 15, 2006, now U.S. Pat. No. 7,682,290 that issued on Mar. 23, 2010 and claims priority on Chinese Application No. 200710106184.X filed Jun. 22, 2007, the disclosures of which are incorporated by reference herein.

BACKGROUND OF THE INVENTION

This invention relates to a stationary exercise apparatus, and more particularly to a stationary exercise apparatus with adjustable components to vary the footpath and enhance exercise intensity of a user.

Stationary exercise apparatus have been popular for several decades. Early exercise apparatus typically had a single mode of operation, and exercise intensity was varied by increasing apparatus speed. More recently, enhancing exercise intensity in some apparatus has been made by adjusting the moving path of user's feet, such as by adjusting the incline or stride length of user's foot path.

U.S. Pat. No. 5,685,804 discloses two mechanisms for adjusting the incline of a stationary exercise apparatus, one of them having a linear track which can be adjusted and the other having a length adjusting swing arm. The swing arm lower end can be moved upwardly for a high incline foot path. U.S. Pat. No. 6,168,552 also discloses a stationary exercise apparatus having a linear track for changing the incline of the stationary exercise apparatus. U.S. Pat. No. 6,440,042 discloses a stationary exercise apparatus having a curved track for adjusting the incline of the stationary exercise apparatus.

Nonetheless, there is still a need for an exercise apparatus that can increase varieties of exercise and enhance exercise intensity of a user.

SUMMARY OF THE INVENTION

A stationary exercise apparatus in accordance with the present invention includes a stationary frame having a base, first and second supporting members coupled to the stationary frame to rotate about an axis, a driving assembly coupled to the base, and first and second pedals coupled to the first and second supporting members. While operating the stationary exercise apparatus, the first and second pedals move along a closed loop path that can have a variety of shapes to vary the exercise experience and intensity. The present invention provides: a user of the stationary exercise apparatus with a benefit of high exercise intensity; an inclined foot path; a variable stride length; a better mode to adjust the inclined foot path; a better gluteus exercise; and a more compact and succinct appearance.

DESCRIPTION OF THE PREFERRED EMBODIMENTS

Figure 1:
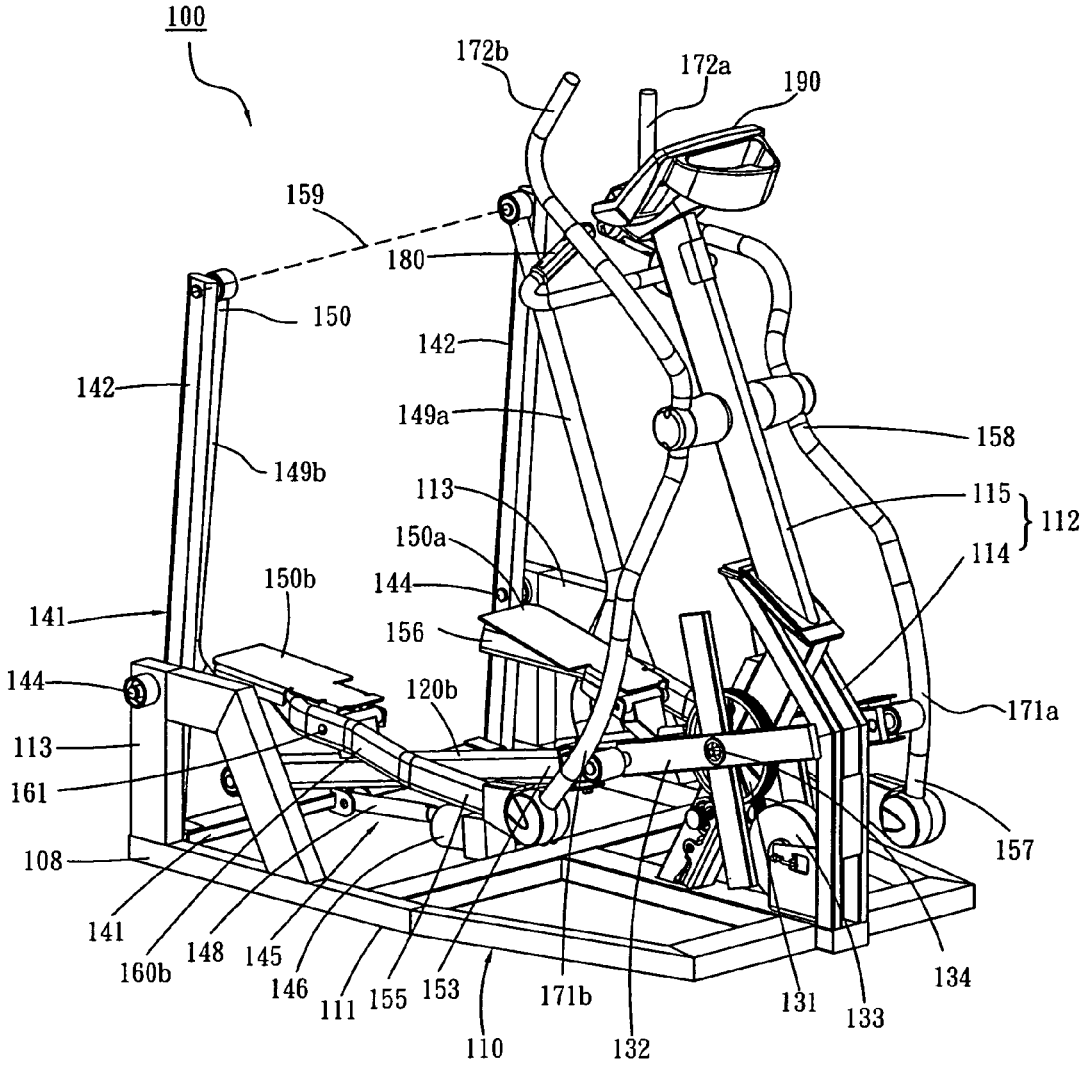
FIG. 1 is a perspective view of a stationary exercise apparatus according to a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Now referring to FIG. 1, a stationary exercise apparatus 100 is illustrated therein. The stationary exercise apparatus 100 has a frame 110 generally comprising a base 111, a front portion 112, a rear portion 108, and side portions 113. The base 111 is substantially a horizontal frame adapted to stably rest on a ground, floor or other similar supporting surface. The front portion 112 is fixed on the base 111, and preferably includes a post 114 and a standard 115. The side portions 113 are respectively mounted on the left and right sides of the base portion 111. A fixed handle assembly 180 and a console 190 are mounted on or near the upper end of the standard 115. Left and right cranks 132 are each pivotally connected to one portion of the frame 110 defining a first axis 134 and in the illustrated embodiment, the first axis 134 is at or near the front portion of the frame 110. The left and right cranks 132 could be replaced by a pair of disks or flywheels rotating about the first axis 134. The left and right cranks 132 and the first axis 134 can also be replaced by a pair of closed tracks circulating about a virtual axis. The frame 110 may further comprise a pulley 131 and a resistance member 133 which is controlled by using the console 190 to vary operating resistance for a user.

Figure 2:
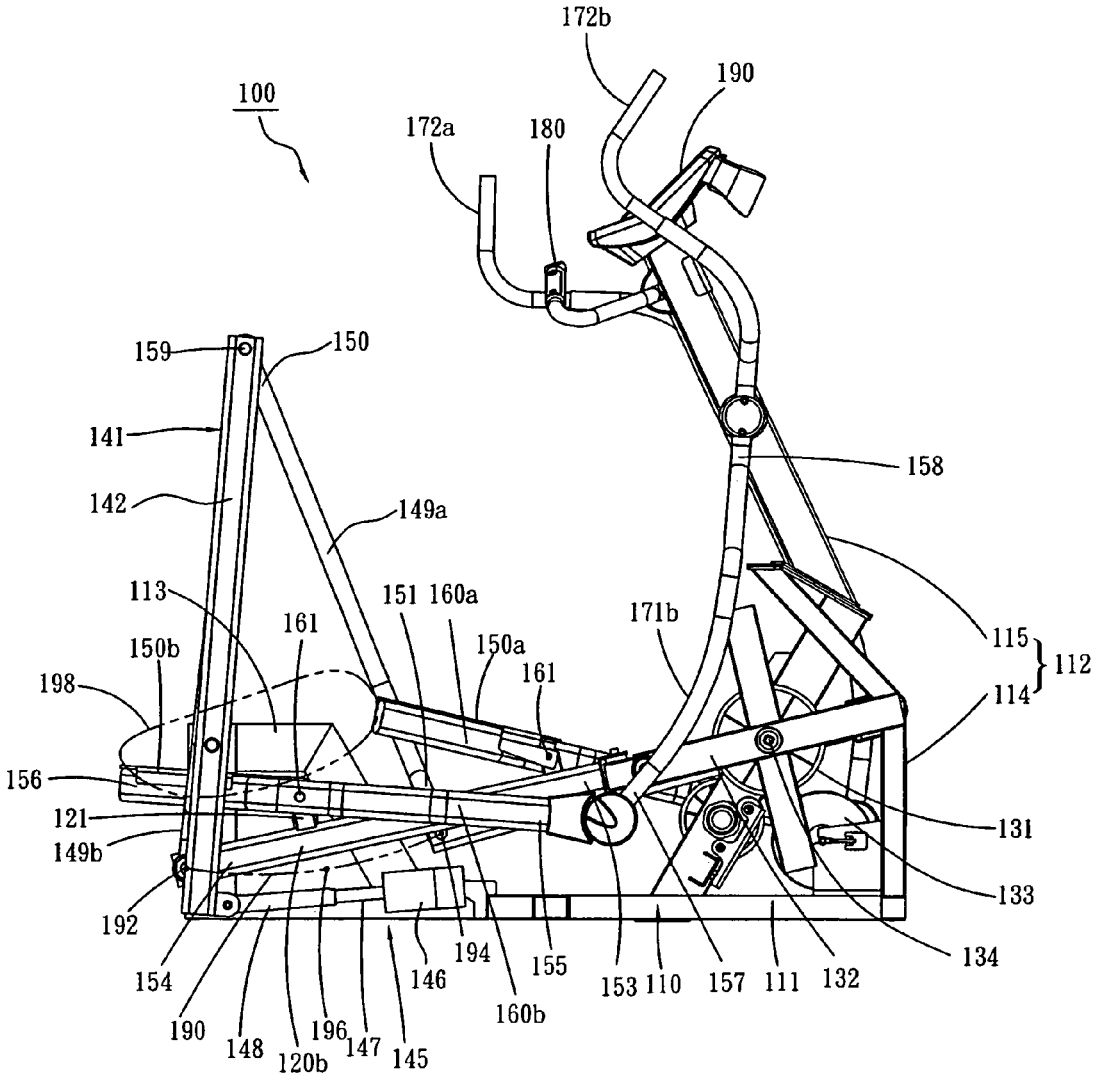
FIG. 2 is a side view of the stationary exercise apparatus of FIG. 1 in a rotating position of a low incline condition.
Figure 3:
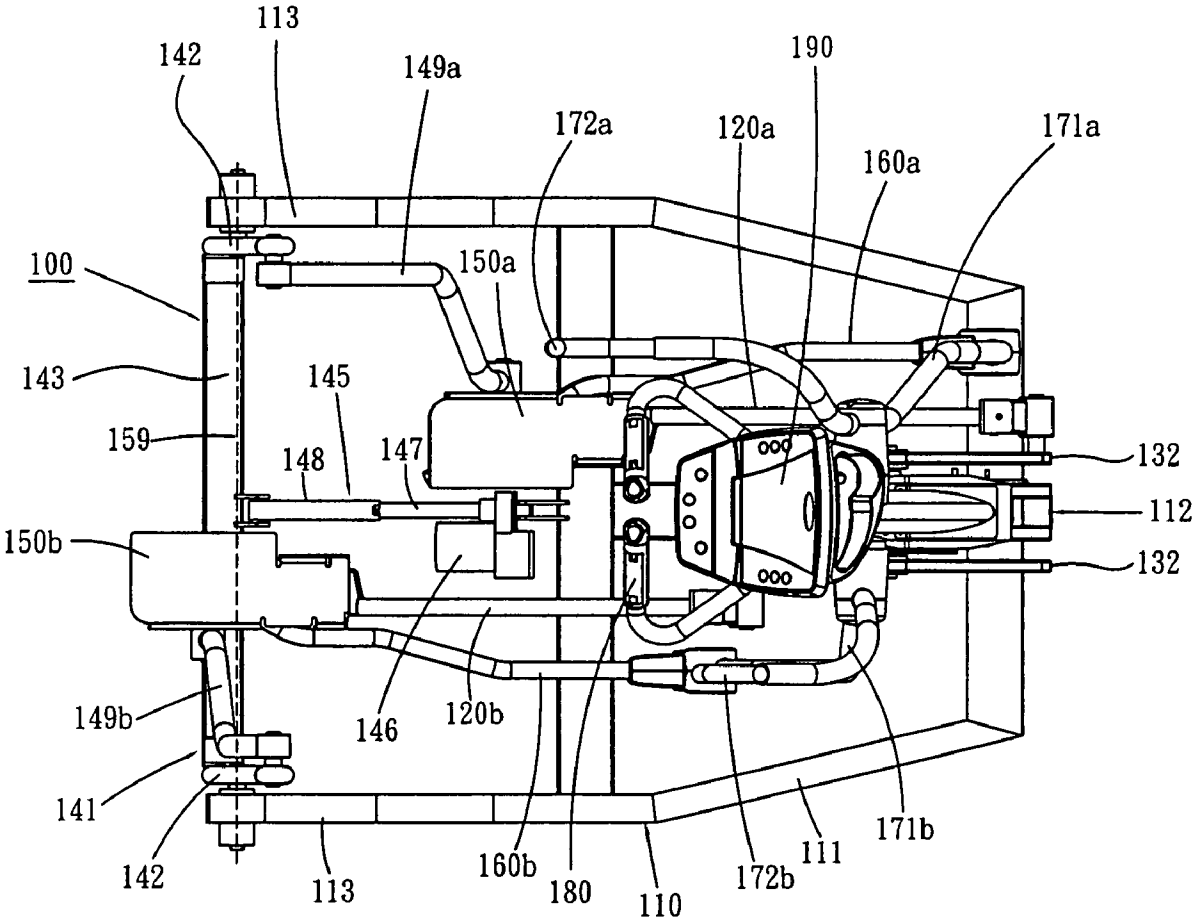
FIG. 3 is a top view of the stationary exercise apparatus of FIG. 1.
Figure 6:
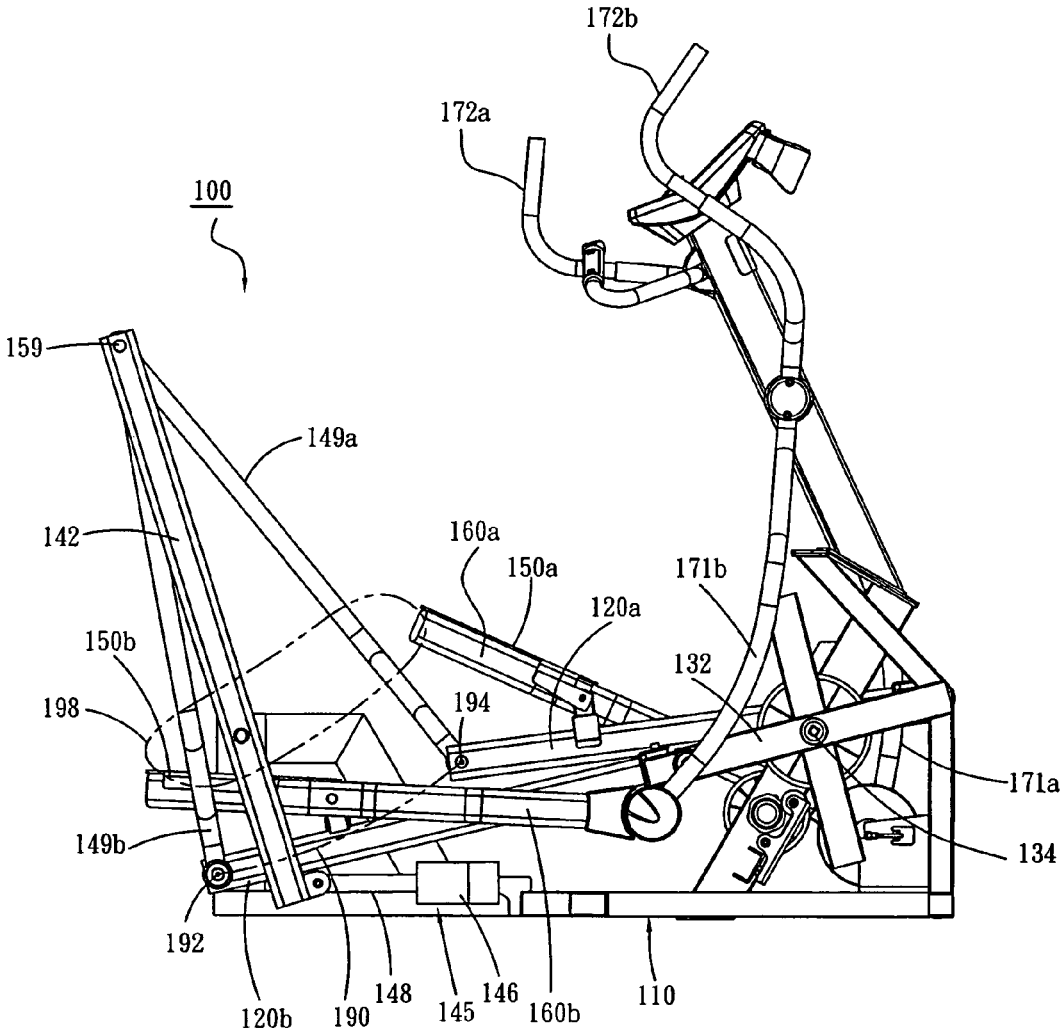
FIG. 6 is a side view of the stationary exercise apparatus of FIG. 1 in a rotating position of a high incline condition.

Now referring to FIGS. 1 and 2, the frame 110 further comprises a moving assembly 141 mounted on the side portions 113 respectively. In a preferred embodiment of the present invention as shown in FIG. 1, the moving assembly 141 has first and second moving members 142, in a generally upright position, and a lateral link 143 (FIG. 4) connecting the first and second moving members 142 to one another. The first and second moving members 142 are joined to the side portions 113 via a second axis 144 so that the upper end portions of the first and second moving members 142 can be adjusted by pivoting the first and second moving members 142 about the second axis 144. There is an optional adjusting assembly 145 mounted between the moving assembly 141 and the frame 110 for adjusting the moving assembly 141 about the second axis 144. The preferred embodiment of the adjusting assembly 145 generally includes a motor 146, a screw rod 147, and a screw tube 148. The motor 146 has one end connected to the base portion 111 and the other end connected to one end of the screw rod 147. The other end of the screw rod 147 is connected to one end of the screw tube 148. The other end of the screw tube 148 is connected to the moving assembly 141 so that the effective length of the screw rod 147 and the screw tube 148 combination is adjustable to move the lower end of the first and second moving members 142 fore and aft. As the lower ends move, the upper ends of the first and second moving members 142 are pivoted in the opposite direction about the second axis 144. The upper end portions of the first and second moving members 142 are adjustable anywhere between a first position as shown in FIG. 2 and a second position as shown in FIG. 6.

The adjusting assembly 145 is illustrated as being mounted on the right side of the exercise device 100, but both moving members 142 are adjusted because a lateral link 143 (FIG. 4) transfers the force to the left side moving member 143. Although described and illustrated as a screw adjusting mechanism, the adjusting assembly 145 could be any manual or automatic mechanical, electromechanical, hydraulic, or pneumatic device and be within the scope of the invention.

Figure 4:
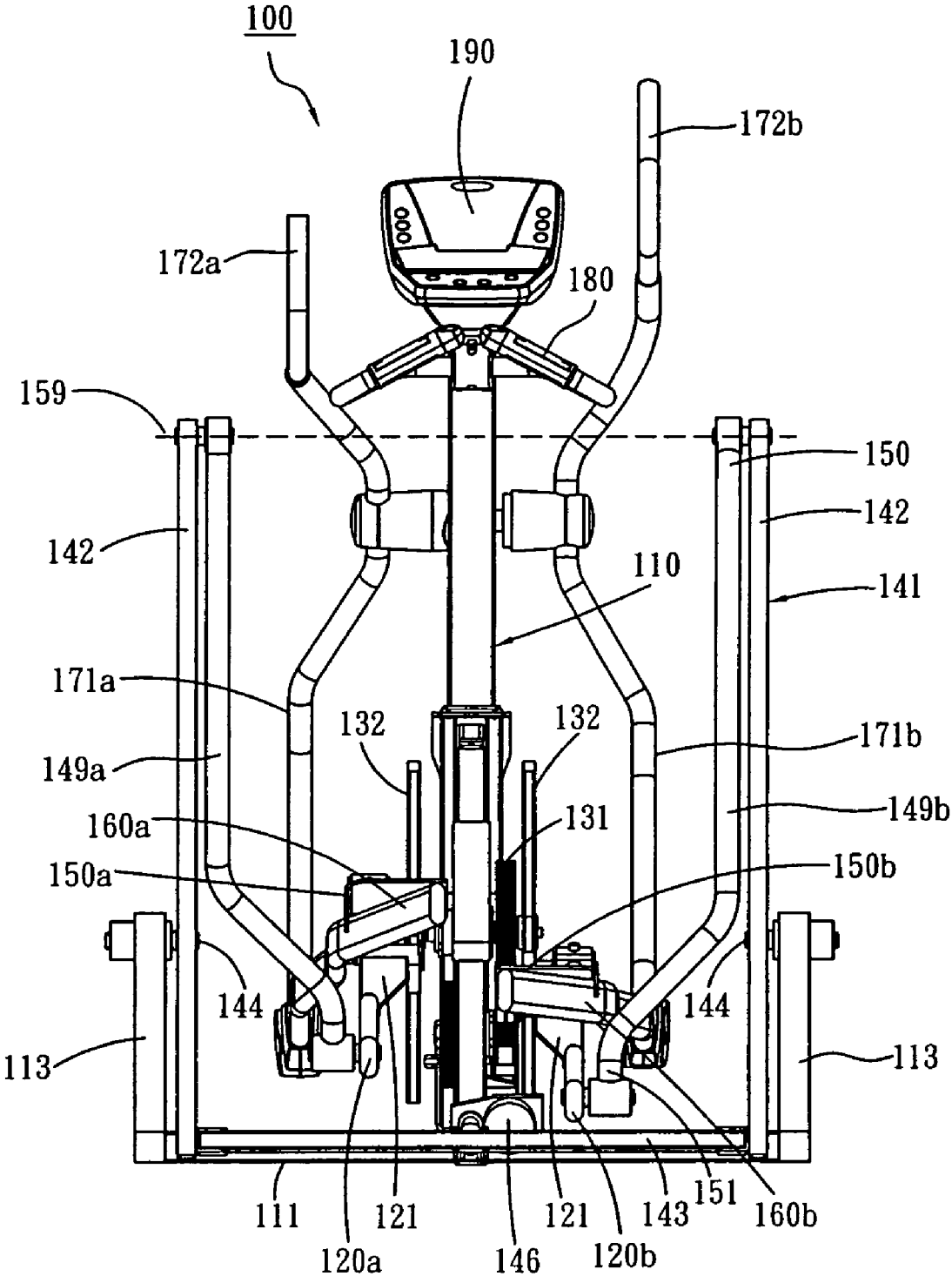
FIG. 4 is a back view of the stationary exercise apparatus of FIG. 1.

Referring to FIGS. 2 and 4, the stationary exercise apparatus 100 comprises first and second swing members 149*a*/149*b*, each of the swing members 149*a*/149*b* having an upper portion 150 and a lower portion 151. The upper portions 150 of the first and second swing members 149*a*/149*b* can be coupled to the frame 110 via a swing axis 159 for swinging motion relative to the frame. In the preferred embodiment of the present invention, the upper portions 150 of the first and second swing members 149*a*/149*b* are respectively pivotally connected to the first and second moving members 142 via the swing axis 159 so that the swing axis 159 can be adjusted forward or backward anywhere between the first position shown in FIG. 2 and the second position shown in FIG. 6. Different positions of the swing axis 159 cause different exercise intensity of the stationary exercise apparatus 100.

Figure 5:
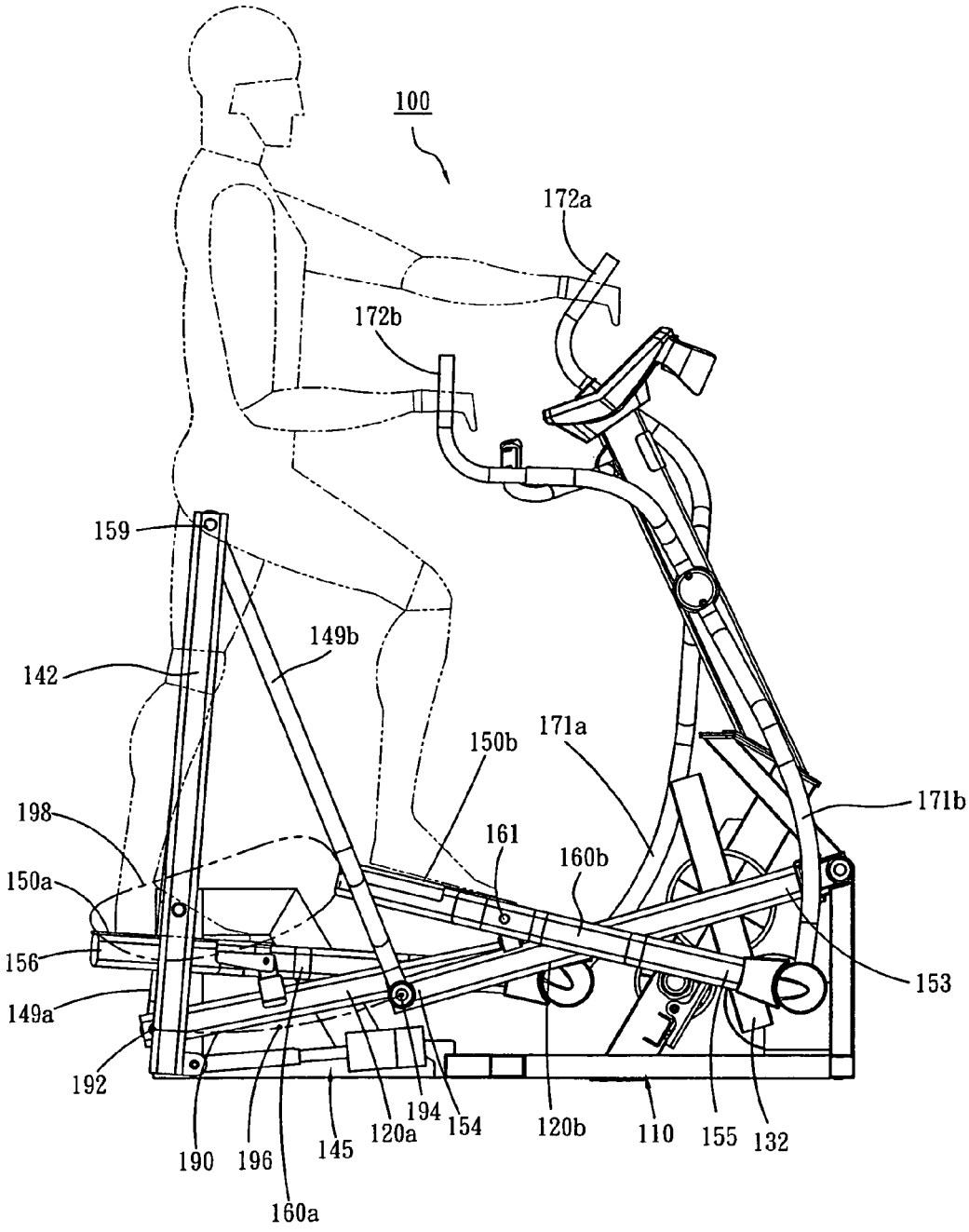
FIG. 5 is a side view of the stationary exercise apparatus of FIG. 1 in another rotating position of the low incline condition.

Now referring to FIGS. 2, 4 and 5, the stationary exercise apparatus 100 comprises first and second supporting members 120*a*/120*b*, each of the first and second supporting members 120*a*/120*b* having a first end portion 153 and a second end portion 154. The first end portions 153 of the first and second supporting members 120*a*/120*b* are respectively coupled to the frame 110 to rotate about the first axis 134. In the preferred embodiment of the present invention, the first end portions 153 of the first and second supporting members 120*a*/120*b* are respectively pivotally connected to the left and right cranks 132 to rotate about the first axis 134. As mentioned previously, the left and right cranks 132 may be replaced by flywheels or disks and the like. The second end portions 154 of the first and second supporting members 120*a*/120*b* are respectively pivotally connected to the lower portions of the first and second swing members 149*a*/149*b* so that the second end portions 154 of the first and second supporting members 120*a*/120*b* may be moved along a reciprocating path 190 (as shown in FIGS. 2 and 5) while the first end portions 153 of the first and second supporting members 120*a*/120*b* are being rotated about the first axis 134.

Referring to FIGS. 1 through 6, the stationary exercise apparatus 100 further comprises first and second control links 160*a*/160*b* respectively pivotally connected to the first and second supporting members 120*a*/120*b*. Each of the first and second control links 160*a*/160*b* has a first end portion 155 and a second end portion 156. The first end portions 155 of the first and second control links 160*a*/160*b* are movably coupled to the frame 110. In the preferred embodiment of the present invention, the first end portions 155 of the first and second control links 160*a*/160*b* are respectively connected to first and second handle links 171*a*/171*b*. More specifically, each of the first and second handle links 171*a*/171*b* has lower and upper end portions. The lower end portions 157 of the first and second handle links 171*a*/171*b* are respectively pivotally connected to the first end portions 155 of the first and second control links 160*a*/160*b* and the upper end portions 158 of the first and second handle links 171*a*/171*b* are pivotally connected to the frame 110 so that, the first and second handle links 171*a*/171*b* can guide the first end portions 155 of the first and second control links 160*a*/160*b* in a reciprocating path. There are several alternatives of performing the same function of the first and second handle links 171*a*/171*b*. For example, the frame 110 can include a pair of tracks allowing the first end portions 155 of the first and second control links 160*a*/160*b* movably coupled to the tracks via rollers or sliders. For simplicity, all such alternatives are referred to herein as "handle links" even when they do not serve as handles for the user.

Still referring to FIGS. 1 through 6, the stationary exercise apparatus 100 includes first and second pedals 150*a*/150*b* respectively coupled to the first and second supporting members 120*a*/120*b*. In the preferred embodiment of the present invention, the first and second pedals 150*a*/150*b* are indirectly connected to the first and second supporting members 120*a*/120*b*. More specifically, the first and second pedals

150*a*/150*b* are respectively attached to the second end portions 156 of the first and second control links 160*a*/160*b* which are pivotally connected to the first and second supporting members 120*a*/120*b*. Therefore, rear end portions 158 of the first and second pedals 150*a*/150*b* are directed by the first and second supporting members 120*a*/120*b* to move along a second closed path 198 (FIGS. 2, 5, and 6) while the first end portions 153 of the first and second supporting members 120*a*/120*b* rotating about the first axis 134. The first and second pedals 150*a*/150*b* can also be directly attached to the first and second supporting members 120*a*/120*b*, similar to the teaching of U.S. Pat. No. 5,685,804. It should be noted that both indirect and direct connections between the first and second pedals 150*a*/150*b* and the first and second supporting members 120*a*/120*b* can cause the rear end portions of the first and second pedals 150*a*/150*b* to move along similar closed paths, and are within the scope of the present invention.

Now referring to FIGS. 2 and 5, the reciprocating path 190 of the first and second swing members 149*a*/149*b* has a rear end 192, a front end 194, and a middle point 196. The middle point 196 is substantially the middle point between the rear end 192 and the front end 194. As shown in FIG. 2, the second end portion of the second support member 120*b* is being at the rear end 192 of the reciprocating path 190 while the first end of the second supporting member 120*b* is being approximately at the rearmost position during rotating about the first axis 134. As also shown in FIG. 5, the second end of the second support member 120*b* is being at the front end 194 of the reciprocating path 190 while the first end of the second supporting member 120*b* is being approximately at the foremost position during rotating about the rotating axis 134. In the preferred embodiment of the present invention, the reciprocating path 190 is substantially arcuate because of the swing motion of the first and second swing members 149*a*/149*b*, but the present invention is not limited to an arcuate reciprocating path. It should be noticed that relative positions between the swing axis 159 and the reciprocating path 190 can cause different exercise intensity of the stationary exercise apparatus 100.

More specifically, the positions of the swing axis 159 can determine incline levels of both the reciprocating path 190 and the second closed path 198. If the swing axis 159 is substantially vertically above the middle point 196 of the reciprocating path 190, the incline level of both the reciprocating path 190 and the second closed path 198 are substantially horizontal. If the swing axis 159 is positioned rearwardly in view of an orientation of an operating user, the incline levels of both the reciprocating path 190 and the second closed path 198 are increased. A higher incline level of the second closed path 198 creates higher exercise intensity of a user. As shown in FIG. 2, the swing axis 159 is positioned slightly in back of the middle point 196 of the reciprocating path 190 so that the second closed path 198 is slightly inclined and the exercise intensity is enhanced. In order to obtain higher exercise intensity, the swing axis 159 can be re-positioned farther toward the rear. As shown in FIG. 6, the swing axis 159 is in back of the rear end 192 of the reciprocating path 190 and both the reciprocating path 190 and the second closed path 198 are in a relatively high incline level so that the exercise intensity of the stationary exercise apparatus 100 is further increased.

In a preferred embodiment of the present invention, the adjusting assembly 145 can be controlled via the console 199 to vary the incline level of the second closed path 198 and to adjust the exercise intensity of the stationary exercise apparatus 100. As mentioned previously, the upper portions 150 of the first and second swing members 149*a*/149*b* are coupled to the moving assembly 141 of the frame 110. The adjusting assembly 145 is connected between the lateral link 143 (FIG. 5) of the moving assembly 141 and the frame 110. Therefore, a user can electronically actuate the adjusting assembly 145 to vary the position of the swing axis 159 and adjust the incline level of the second closed path 198. It should be noted that the (lateral) link 143 could be omitted in some embodiments, not shown in the figures. For example, two adjusting assemblies 145 are directly connected to the first and second moving members 142 respectively. The benefit of omitting the (lateral) link 143 is that the height of the first and second pedal 150*a*/150*b* could be lower because of less interference between the (lateral) link 143 and the second end portions of the first and second supporting members 120*a*/120*b*. A user may feel more comfortable in a lower operating position. It should also be noticed that the incline level of the stationary exercise apparatus 100 is not limited to an electronically adjustment. Some manual adjustments, such as pin and holes combinations, levers, cranks and the like are also within the scope of the present invention.

FIG. 5 shows the swing axis 159 is positioned to the rear of the middle point 196 of the reciprocating path 190 and the second closed path 198 is in a low incline level. FIG. 6 shows the swing axis 159 is positioned to the rear of the rear end 192 of the reciprocating path 190 and the second closed path 198 is in a higher incline level. In other embodiments of the present invention, the incline level of the second closed path 198 could also be non-adjustable. For example, the side portions 113 of the frame 110 extend upwardly and the first and second swing members 149*a*/149*b* are directly pivotally connected to the side portions 113 of the frame 110. In the non-adjustable embodiments, when the swing axis 159 is positioned slightly in back of the middle point 196, the second closed path 198 is in the low incline level, not flat, such as shown in FIG. 5. When the swing axis 159 is positioned in back of the rear end 192 of the reciprocating path 190, the second closed path 198 would be in the high incline level as shown in FIG. 6. Both the low and high incline level of the stationary exercise apparatus 100 can enhance exercise intensity of a user, comparing to a more horizontal incline level.

To operate the stationary exercise apparatus 100, a user respectively steps on the first and second pedals 150*a*/150*b* and grabs onto the fixed handle assembly 180 or onto a pair of moving handles 172*a*/172*b*. The first end portions 153 of the first and second supporting members 120*a*/120*b* rotate along a substantially arcuate path about the first axis 134 and the second ends of the first and second supporting members 120*a*/120*b* move along the reciprocating path 190. Therefore, rear end portions of the first and second pedals 150*a*/150*b* move along the second closed path 198. As mentioned previously, the positions of the swing axis 159 are relative to some geometry parameters of the second closed path 198 and have great effects on the exercise intensity of a user of the stationary exercise apparatus 100.

Figure 7:
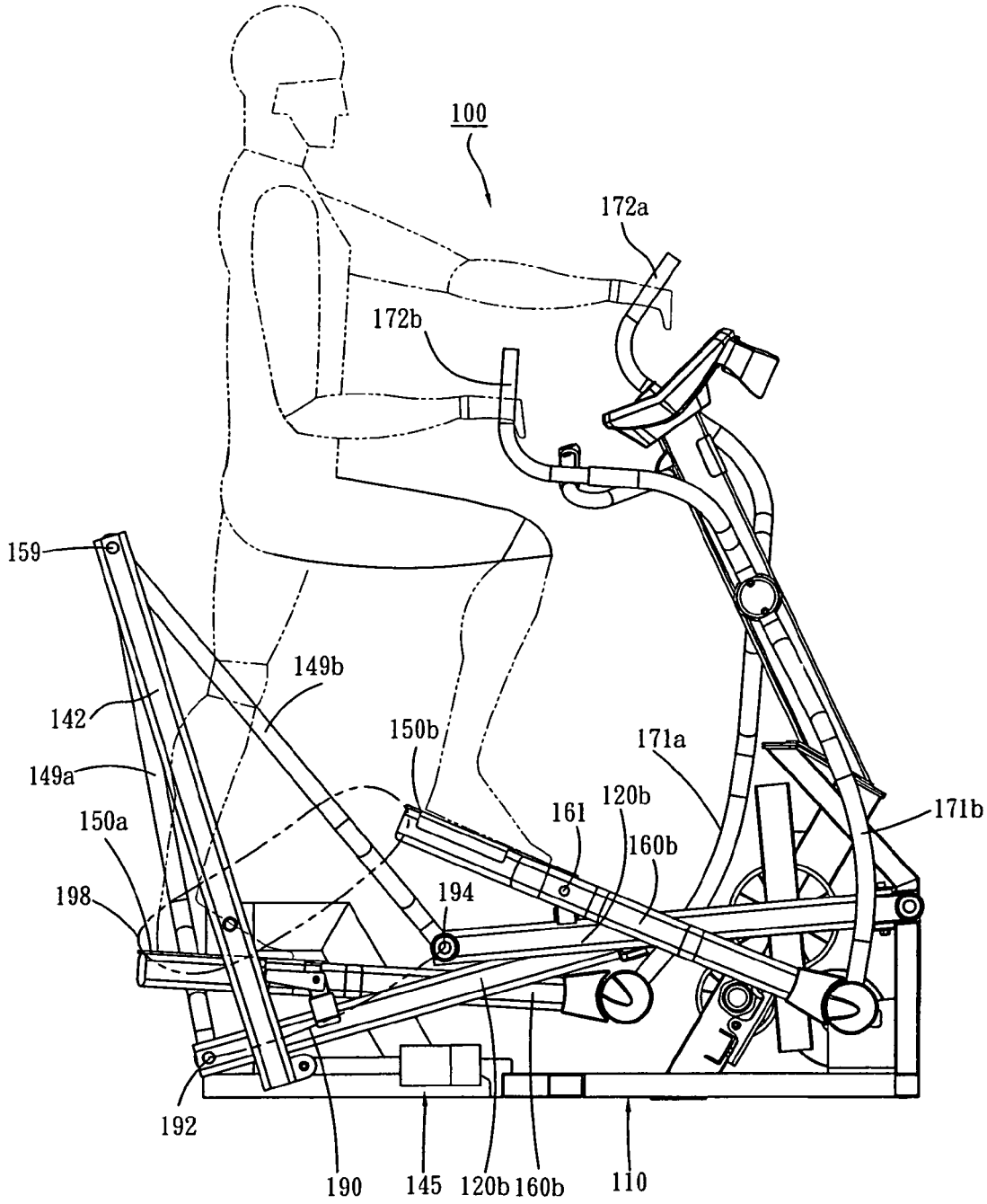
FIG. 7 is a side view of the stationary exercise apparatus of FIG. 1 in another rotating position of the high incline condition demonstrating better gluteus exercise of a user.
Figure 8:
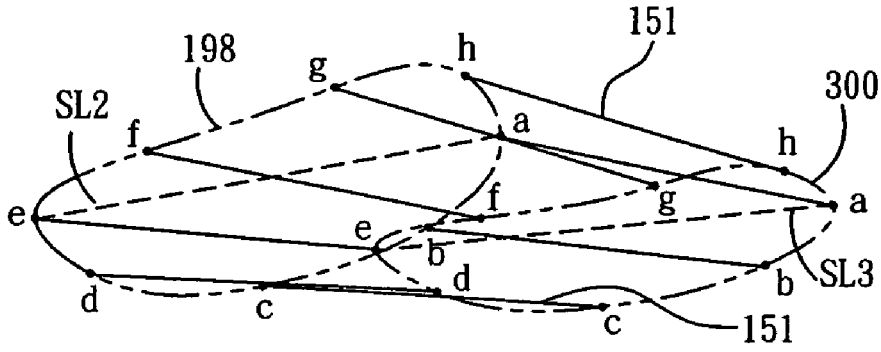
FIG. 8 are toe and heel path profiles of the stationary exercise apparatus of FIG. 1 in a relatively low incline condition.
Figure 9:
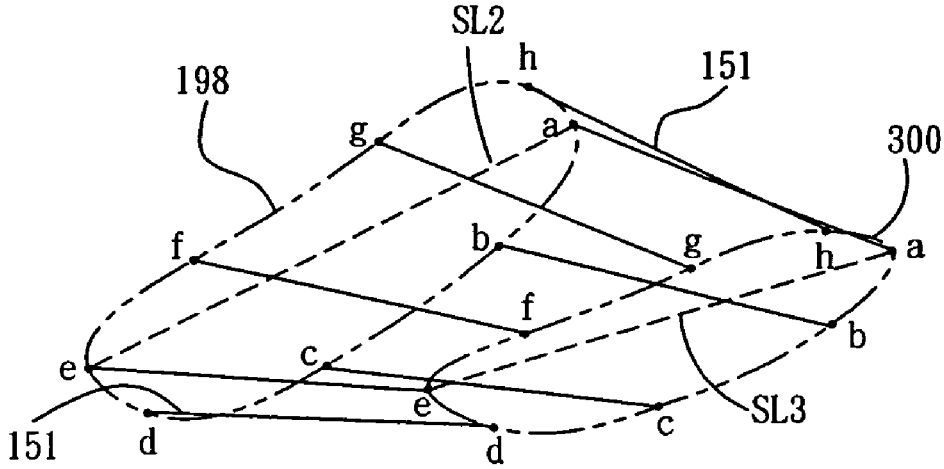
FIG. 9 are toe and heel path profiles of the stationary exercise apparatus of FIG. 1 in a relatively high incline condition.
Figure 10:
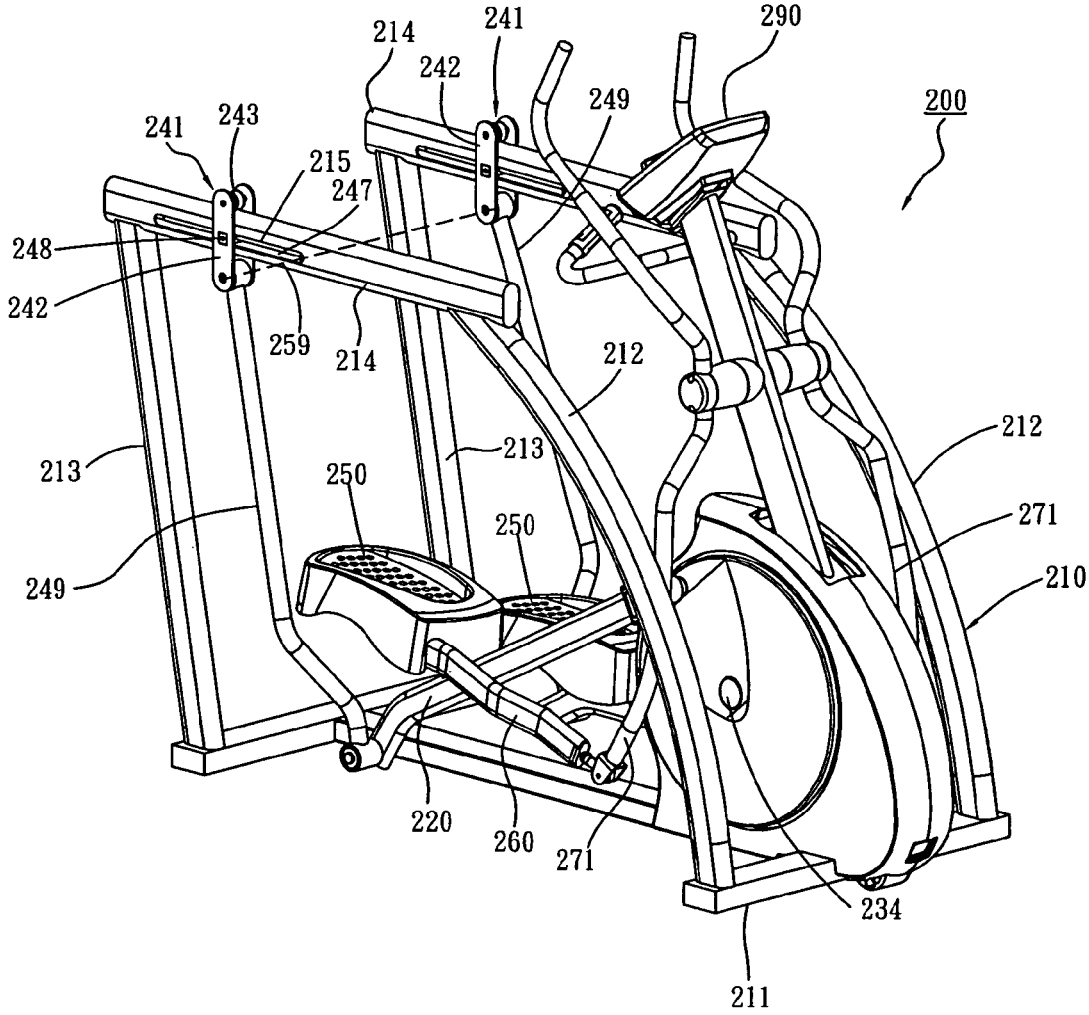
FIG. 10 is a perspective view of a stationary exercise apparatus according to another embodiment of the present invention.
Figure 11:
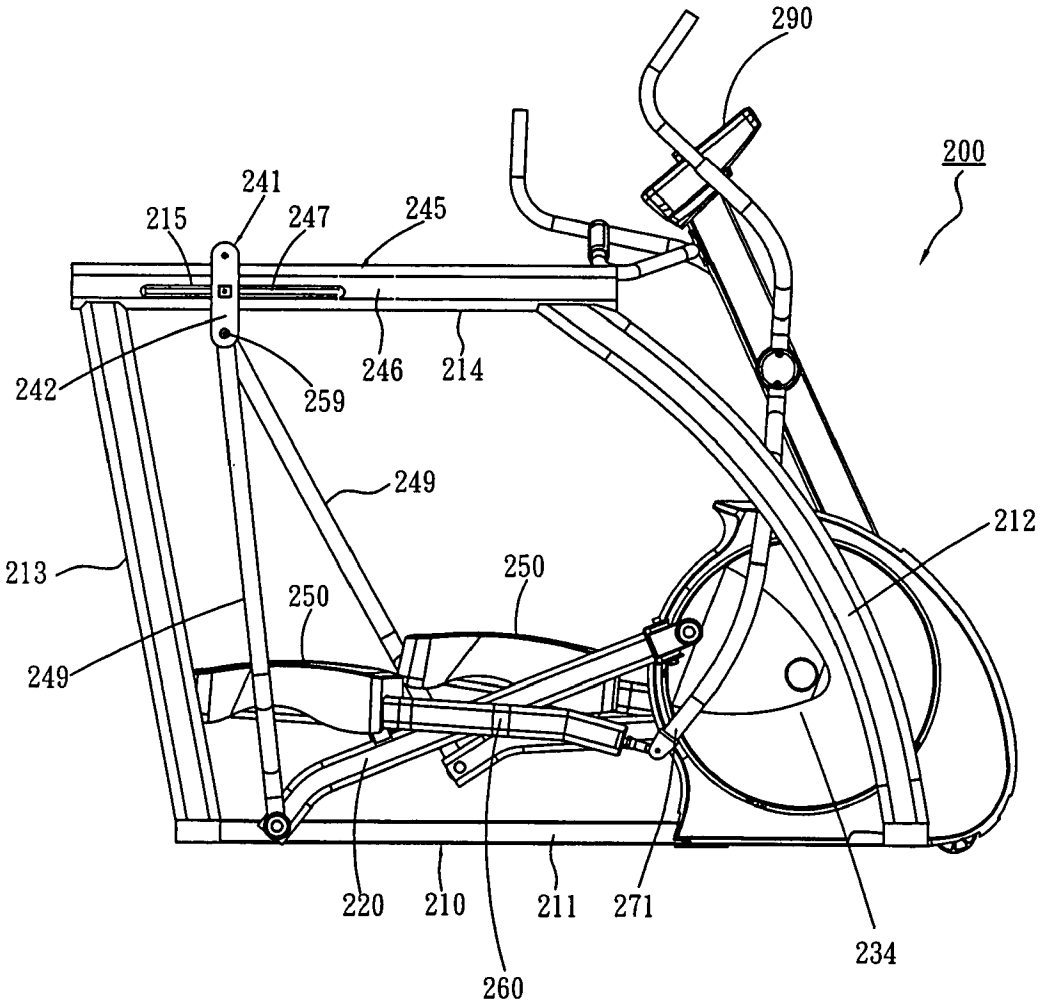
FIG. 11 is a side view of the stationary exercise apparatus of FIG. 10.
Figure 12:
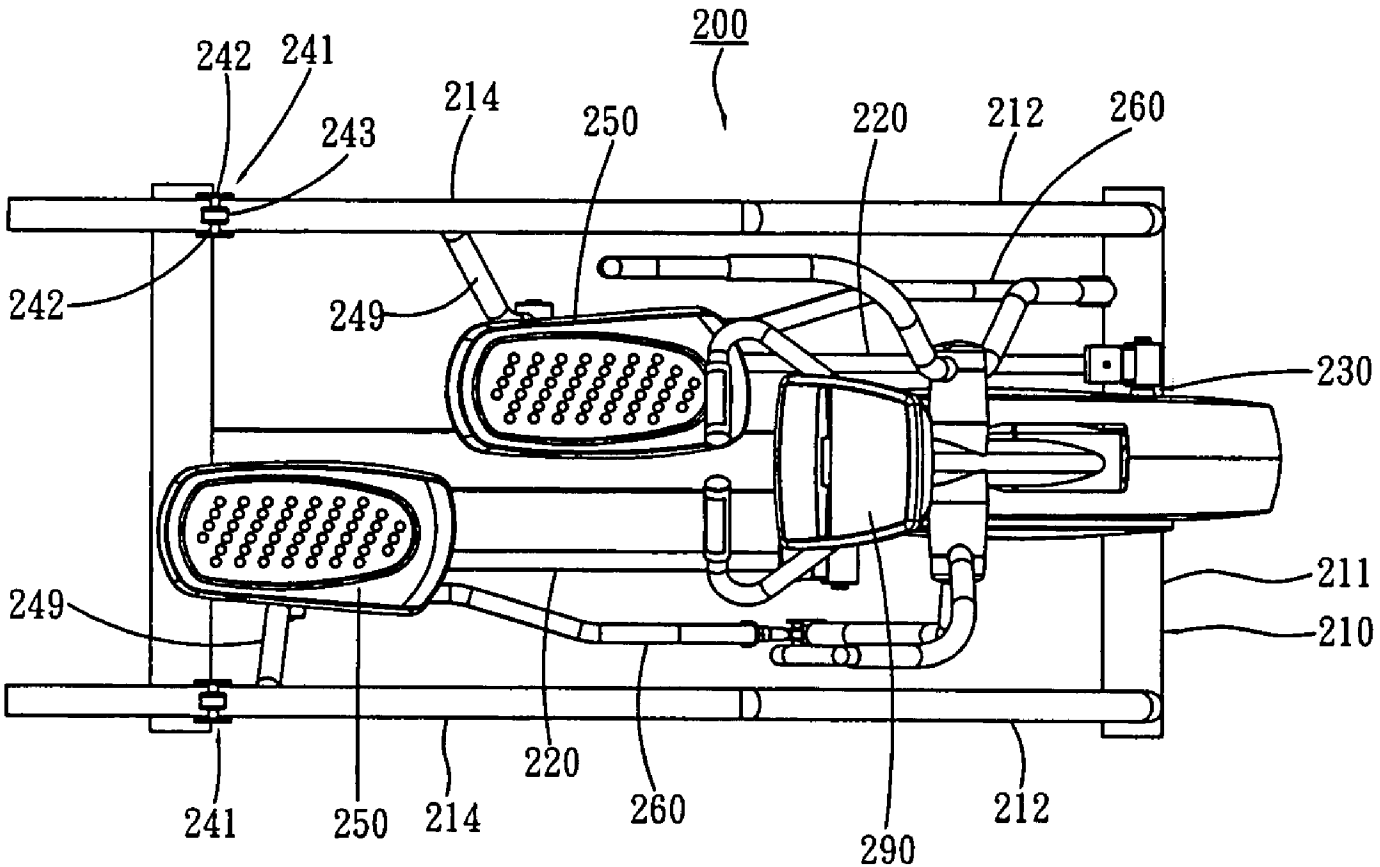
FIG. 12 is a top view of the stationary exercise apparatus of FIG. 10.

To better present the relationship between the swing axis 159 and the second closed path 198, separated path information is illustrated in FIGS. 8 and 9. FIG. 8 shows the path information and geometry parameters while the swing axis 159 is slightly in back of the middle point 196 as shown in FIG. 5. FIG. 9 shows the path information and geometry parameters while the swing axis 159 is to the rear of the rear end 192 as shown in FIGS. 6 and 7.

Now referring to FIG. 8 in more detail, the second closed path 198, representing the path of the rear end portion of the pedals 150*a*/150*b*, is represented by eight points, a~h. As the first end portion 153 of the supporting members 120*a*/120*b* rotates around the first axis 134 in a substantially circular path, that path can be divided into 8 equally spaced positions around the circular path, each position separated by an angle of 45 degrees. The geometry of the current invention causes these 8 equally spaced positions of the first end portion 153 rotating about the first axis 134 to map to points a~h on the second closed path 198. Points a and e represent the foremost and rearmost positions, respectively, of the rear end portion of the pedals 150*a*/150*b*, as the first ends of the first and second supporting members 120*a*/120*b* rotate about the first axis 134. A stride length SL2, corresponding to the line made by points a and e, is also one of the geometry parameters of the second closed path 198, in addition to the incline level. The stride length SL2 is substantially the stride length of the heel portion of a user because the second closed path 198 is the moving path of the rear ends of the pedals 150*a*/150*b* and the heel portion of a user is proximate to the rear ends of the pedals 150*a*/150*b*. Stride length is also relative to exercise intensity. A longer stride length generally results in higher exercise intensity. A third closed path 300 is the moving path of the front ends of the pedals 150*a*/150*b*, and is represented by 8 points, a'~h'. A stride length SL3 may also substantially represent the stride length of the toe portion of a user. Because the closed paths 198 and 300 are moving paths of the rear and front ends of the pedals 150*a*/150*b*, the orientation of the pedals 150*a*/150*b* can be illustrated by a pedal orientation 151 as shown in FIG. 8. One important character of the pedal orientation 151 is that the steepness of the pedal orientation 151 is increased when the swing axis 159 is adjusted backwardly.

FIG. 9 shows the stride length SL2, stride length SL3, pedal orientation 151, second closed path 198, and third closed path 300 while the swing axis 159 is in back of the rear end 192 of the arcuate path 190. As shown in FIG. 7, the first and second control links 160*a*/160*b* are respectively pivotally connected to the first and second supporting members 120*a*/120*b* via pivot axes 161. The incline level of the second closed path 198 of FIG. 9 is increased by 17 degrees compared to the incline level of FIG. 8, but the incline level of the third closed path 300 of FIG. 9 is only increased by 11 degrees. That is, the incline level of the second closed path 198 is increased more than the incline level of the third closed path 300 while the swing axis 159 is being adjusted backwardly. The stride length SL2 of FIG. 9 is increased by about 15 percent compared to the stride length SL2 as shown in FIG. 8, but the stride length SL3 of FIG. 9 is only increased by about 6 percent. That is, the stride length SL2 is increased more than the stride length SL3 while the swing axis 159 is being adjusted backwardly. Because both path inclination and stride length of the heel portion of a user are increased more than the toe portion, the exercise intensity of the heel portion is higher than the exercise intensity of the toe portion of a user which may also imply a higher exercise intensity of the gluteus of a user. Because the heel portion of the user is obviously elevated as shown in FIG. 7, the thigh of the user is elevated to a substantially horizontal orientation relative to the ground surface so that the gluteus of the user is fully exercised.

Now referring to FIGS. 10 through 13, a second preferred embodiment of the present invention is shown. A stationary exercise apparatus 200 comprises a frame 210 having a base portion 211 adapted to rest on a surface. The frame 210 further comprises a front portion 212 extending upwardly from the base portion 211, a side portion 214 extending longitudinally rearward from the front portion 212, and a rear portion 213 connecting the side portion 214 and the base portion 211.

The stationary exercise apparatus 200 further has first and second supporting members 220, each of the supporting members 220 having a first end portion and a second end portion. The first end portions of the first and second supporting members 220 are respectively pivotally connected to a pair of rotating members 233 in order to rotate about a first axis 234. The second end portions of the first and second supporting members 220 are respectively connected to the lower portions of first and second swing members 249. The upper portions of the first and second swing members 249 are coupled to the side portion 214 of the frame 210 via a swing axis 259. More specifically, the upper portions of the first and second swing members 249 are pivotally connected to left and right moving assemblies 241.

Each of the left and right moving assemblies 241 respectively comprises third and fourth moving members 242. Each of the third and fourth moving members 242 is connected to left and right adjusting assemblies 245 (FIG. 11) so that the moving assemblies 241 could be driven by the adjusting assemblies 245. Each of the left and right moving assemblies 241 further includes an optional roller 243. The rollers 243 are respectively engaged on the side portion 214 for increasing stability and smoothness of movement of the moving assemblies 241 along the side portion 214.

Figure 13:
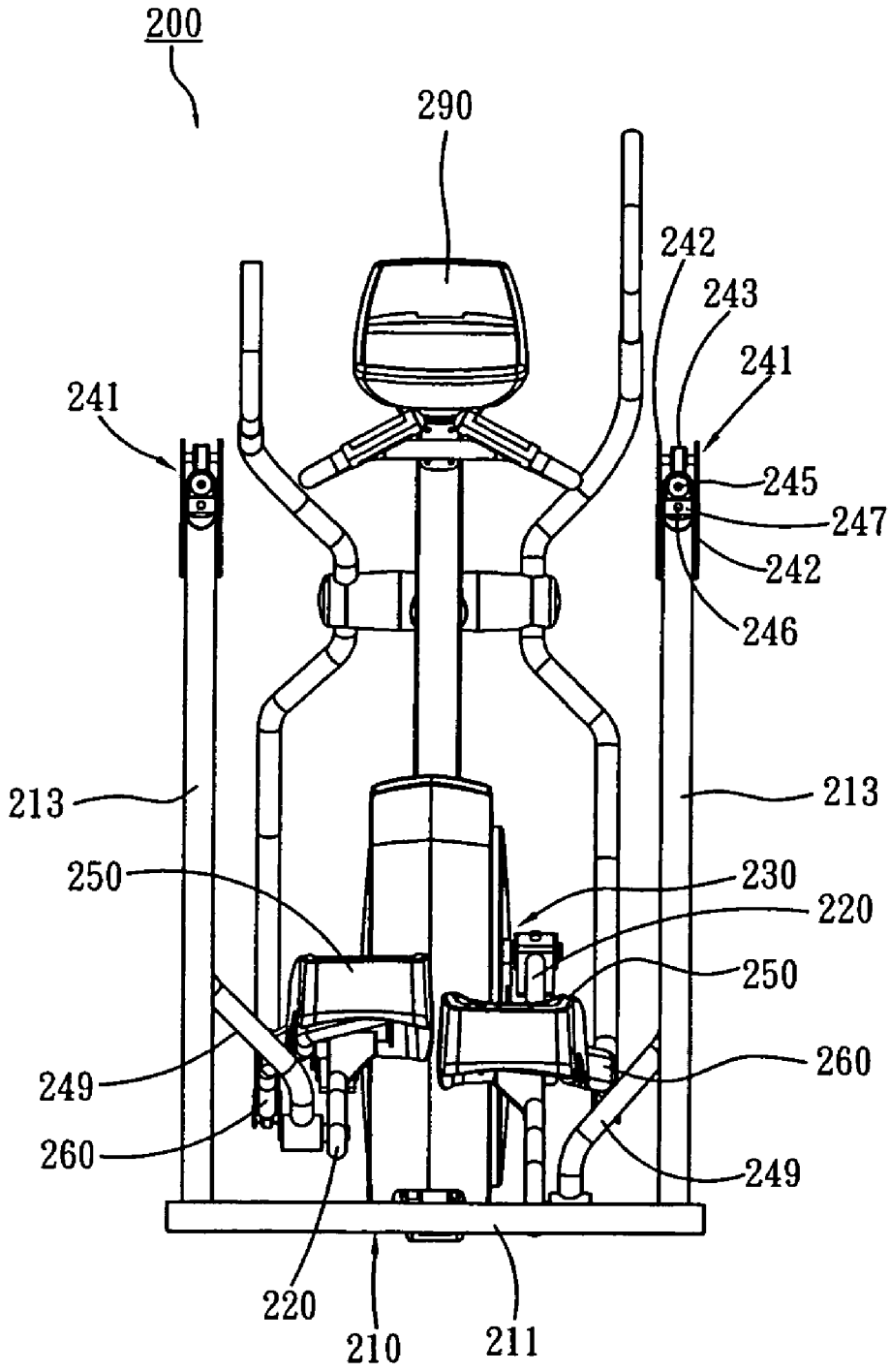
FIG. 13 is a back view of the stationary exercise apparatus of FIG. 10.

As illustrated in FIG. 13, each of the adjusting assemblies 245 includes a motor 246 mounted on one portion of the frame 210, a screw rod 247, and a screw member 248. The screw rod 247 has one end connected to the motor 246 and a portion adapted for movement of the screw member 248. Although described and illustrated as a screw adjusting mechanism, the adjusting assembly 245 could be any manual or automatic mechanical, electromechanical, hydraulic, or pneumatic device and be within the scope of the invention.

In the second preferred embodiment of the present invention, the upper portions of the first and second swing members 249 are respectively pivotally connected to the third and fourth moving members 242. But, the upper portions of the first and second swing members 249 can also be directly pivotally connected to the screw members 248 of the adjusting assemblies 245. Therefore, actuating of the motor 246 can cause rotation of the screw rod 247 to change the positions of both the third and fourth moving member 242 and the swing axis 259.

Similar to the previous preferred embodiment of the stationary exercise apparatus 100, the stationary exercise apparatus 200 also comprises a pair of pedals 250 respectively coupled to the supporting members 220. Optionally, the stationary exercise apparatus 200 also has a pair of control links 260 respectively pivotally connected to the supporting members 220 and a pair of handle links 271 coupled to the frame 210 for guiding the control links 260.

Figure 14:
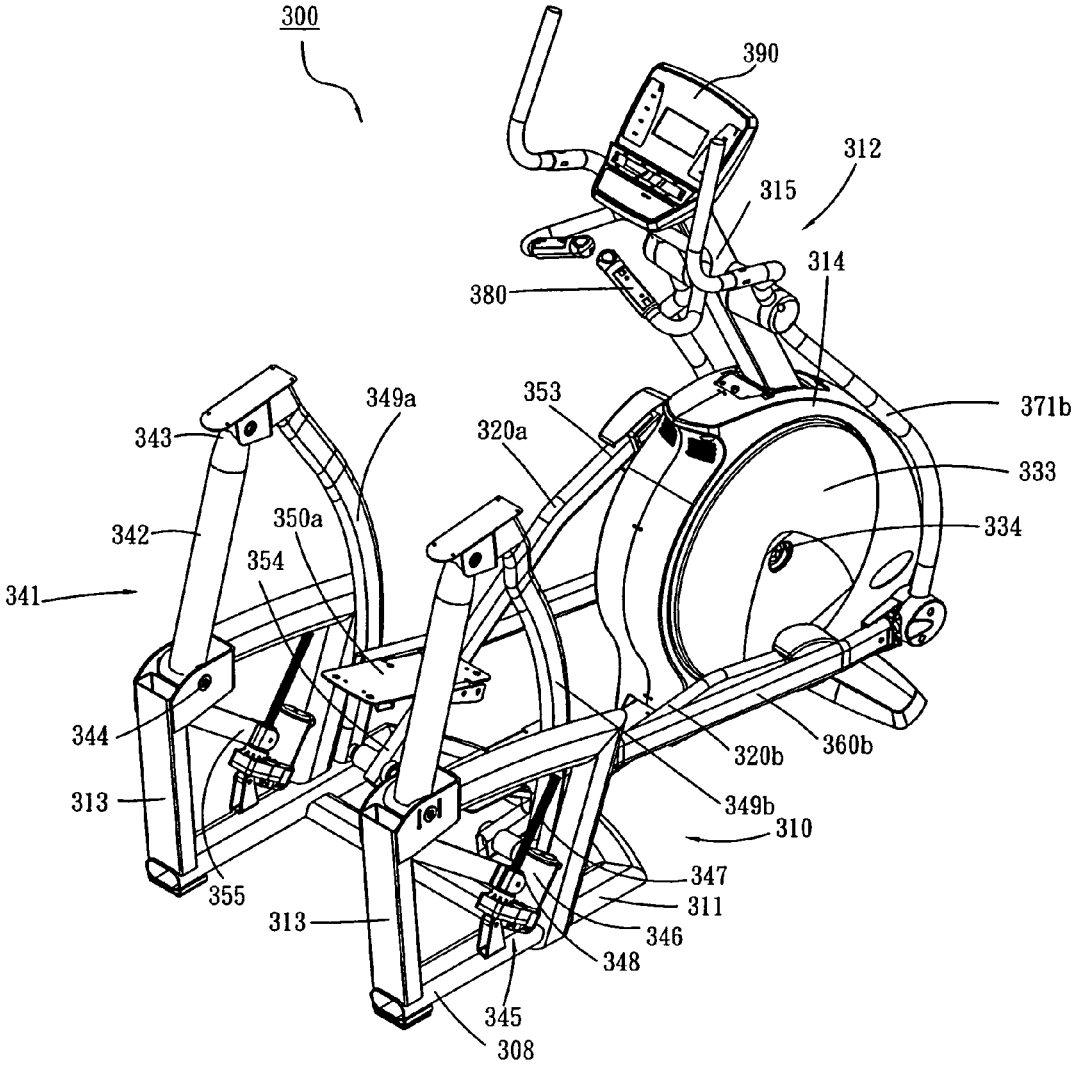
FIG. 14 is a perspective view of a third embodiment of a stationary exercise device in accordance with the present invention.
Figure 15:
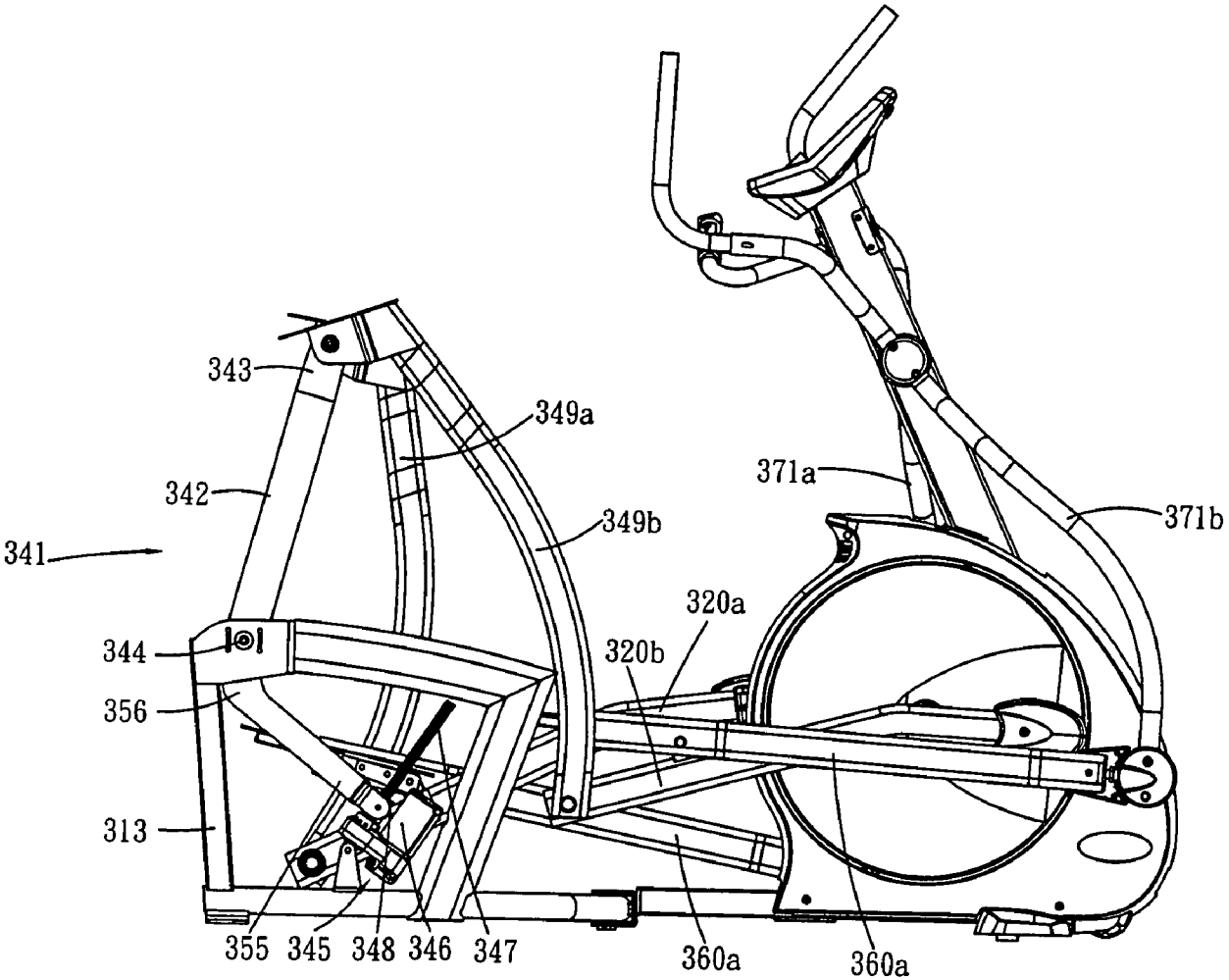
FIG. 15 is a side view of the stationary exercise apparatus of FIG. 14.
Figure 16:
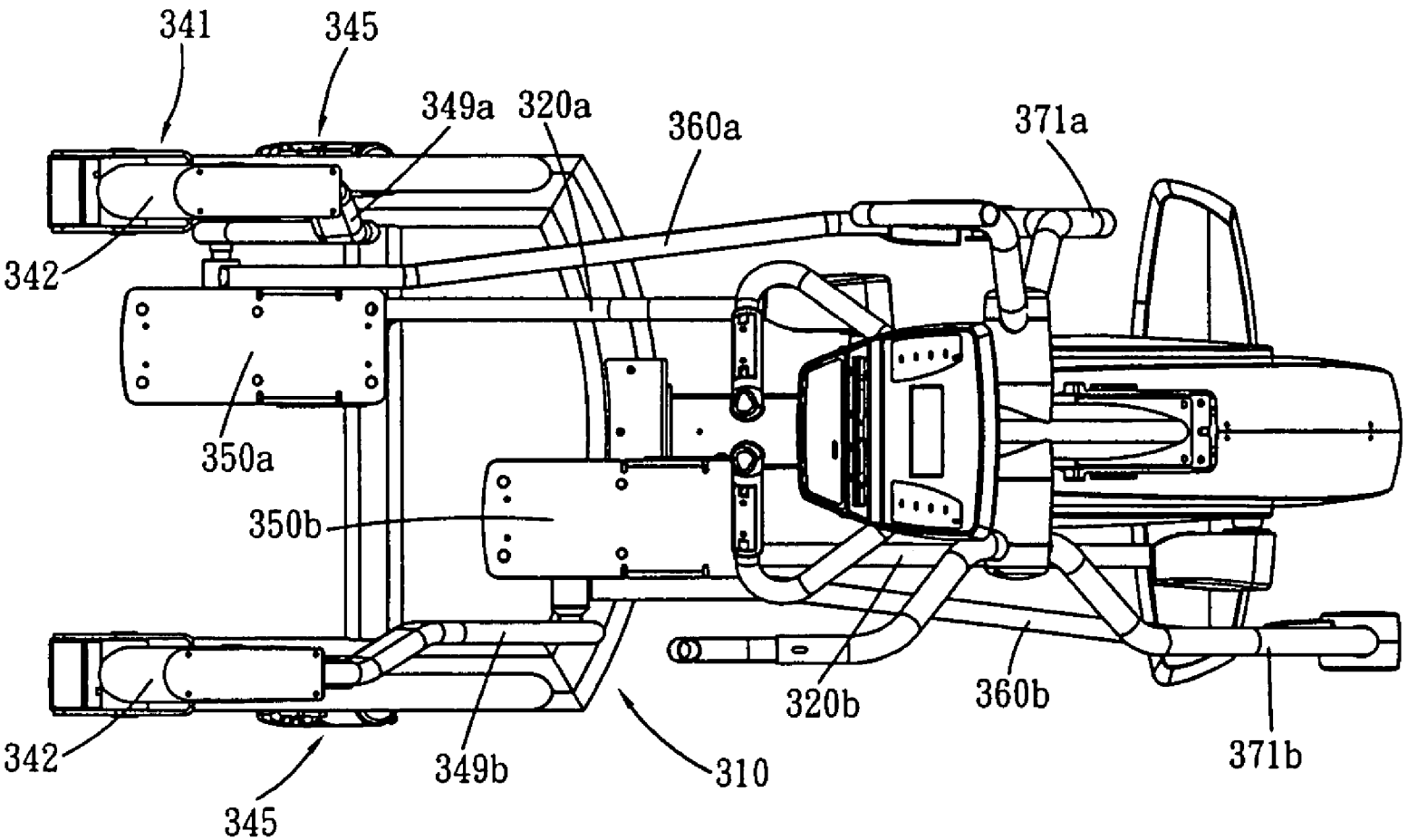
FIG. 16 is a top view of the stationary exercise apparatus of FIG. 14.

FIGS. 14 through 16 illustrate an embodiment similar to the embodiment illustrated in FIGS. 1 through 9. This third embodiment of a stationary exercise apparatus 300 includes a frame 310 having a base 311, a front portion 312, a rear portion 308, and side portions 313. The frame 310 may also include a post 314 within the plastic cover and a standard 315. A handle assembly 380 and a console 390 are also provided as described above in relation to the first and second embodiments.

The third embodiment of the exercise apparatus 300 includes rotating members 333 that rotate about a first axis 334, similar to those described and illustrated in relation to the second embodiment 200 (FIGS. 10 through 13). An optional resistance member similar to the arrangement of the resistance member 133 shown in FIG. 1 is also provided.

Similar to the embodiment illustrated in FIGS. 1 to 9, the third embodiment of the exercise apparatus 300 also includes first and second supporting members 320*a*/320*b*, each having a first end portion 353 rotatably joined to the rotating members 333 and a second end portion 354. The second end portions 354 are respectively joined to swing members 349*a*/349*b*. The swing members 349*a*/349*b* are pivotally coupled to the first and second moving members 342 in the moving assembly 341 in a manner substantially similar to that described in relation to the first embodiment 100. In turn, the moving assembly 341 is pivotally coupled to the frame side portions 313.

The moving assembly 341 includes first and second moving member 342 that are defined by an upper portion 343 and a lower portion 355 joined at an elbow 356, so that the upper portion 343 and the lower portion 355 are at an angle to one another as illustrated. The first and second moving members 342 are joined to the side portions 313 via a second axis 344 to pivot as described above.

An optional adjusting assembly 345 is provided on each side of this embodiment. The adjusting assembly 345 activates the moving assembly 341 about the second axis 344. The adjusting assembly includes a motor 346, a screw rod 347, and a threaded nut, sleeve, or tube 348. The motor 346 is connected to the base 311 and to the screw rod 347. In this embodiment, the screw rod 347 is generally upright and angled slightly forward. The screw rod 347 is threaded through the tube 348, which is pivotally mounted on the lower portion 355 of the moving members 342. In this manner, the motor 346 can be activated automatically or manually from the console 390 to rotate the screw rod 347, which in turn raises or lowers the tube 348 along the screw rod 347. As the tube 348 is raised or lowered, the moving member 342 pivots about the second axis 344. A manually operated adjusting assembly could also be used, as described above.

In this embodiment of the exercise apparatus 300, the swing members 349*a*/349*b* are illustrated as arcuate in shape so that the support members 320*a*/320*b* need not extend rearwardly as far as those illustrated in previous embodiments. Otherwise, the operation of the swing member 349*a*/349*b* and the support members 320*a*/320*b* are essentially as described above.

First and second pedals 350*a*/350*b* are respectfully coupled to the first and second supporting members 320*a*/320*b*, either directly or indirectly. To couple the pedals 350*a*/350*b* indirectly to the support members 320*a*/320*b*, there are provided first and second control links 360*a*/360*b* which are pivotally connected to the support members 320*a*/320*b*. The pedals 350*a*/350*b* are joined to the control links 360*a*/360*b* and move in a second closed path when the support members 320*a*/320*b* move as described above.

Handle links 371*a*/371*b* are illustrated for this embodiment, and as with the above embodiments, may be substituted by tracks, rollers, sliders, and the like to provide support for the moving first end portions of the control links 360*a*/360*b*. Any such device is referred to herein as a "handle link" regardless of whether it actually serves as a handle for a user.

FIGS. 17 through 27B illustrate an embodiment having substantial portions similar to the embodiment shown in FIGS. 1 through 9. Illustrated in FIGS. 17 through 22 is a stationary exercise apparatus 400 including a stationary frame 410 having a base 411 and a post 412 mounted to the front of the base 411. The stationary frame 410 also includes a standard 414 extended substantially upward from the top of the post 412. A fixed handle assembly 480 and a console 416 are also provided as described above in relation to the previous embodiments.

Figure 22:
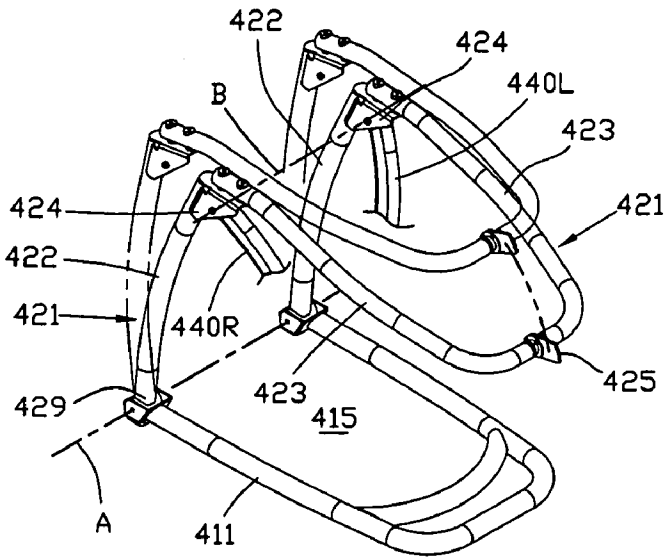
FIG. 22 is a partial perspective view of FIG. 17, showing the movable frame in both a lower and higher incline condition.

The stationary exercise apparatus 400 also includes on each side, a movable frame 421 having a first portion 423 and a second portion 422. The second portion 422 of each side of the movable frame 421 is pivotally connected by a pivot 429 to the base 411 of the stationary frame 410 so that the movable frame 421 can pivot about an axis A, as illustrated in FIG. 22. The movable frame 421 is connected to a lifting member 425. The lifting member 425 is optional, but it provides a convenient mechanical interface with the motorized lifting mechanism components described below.

Figure 17:
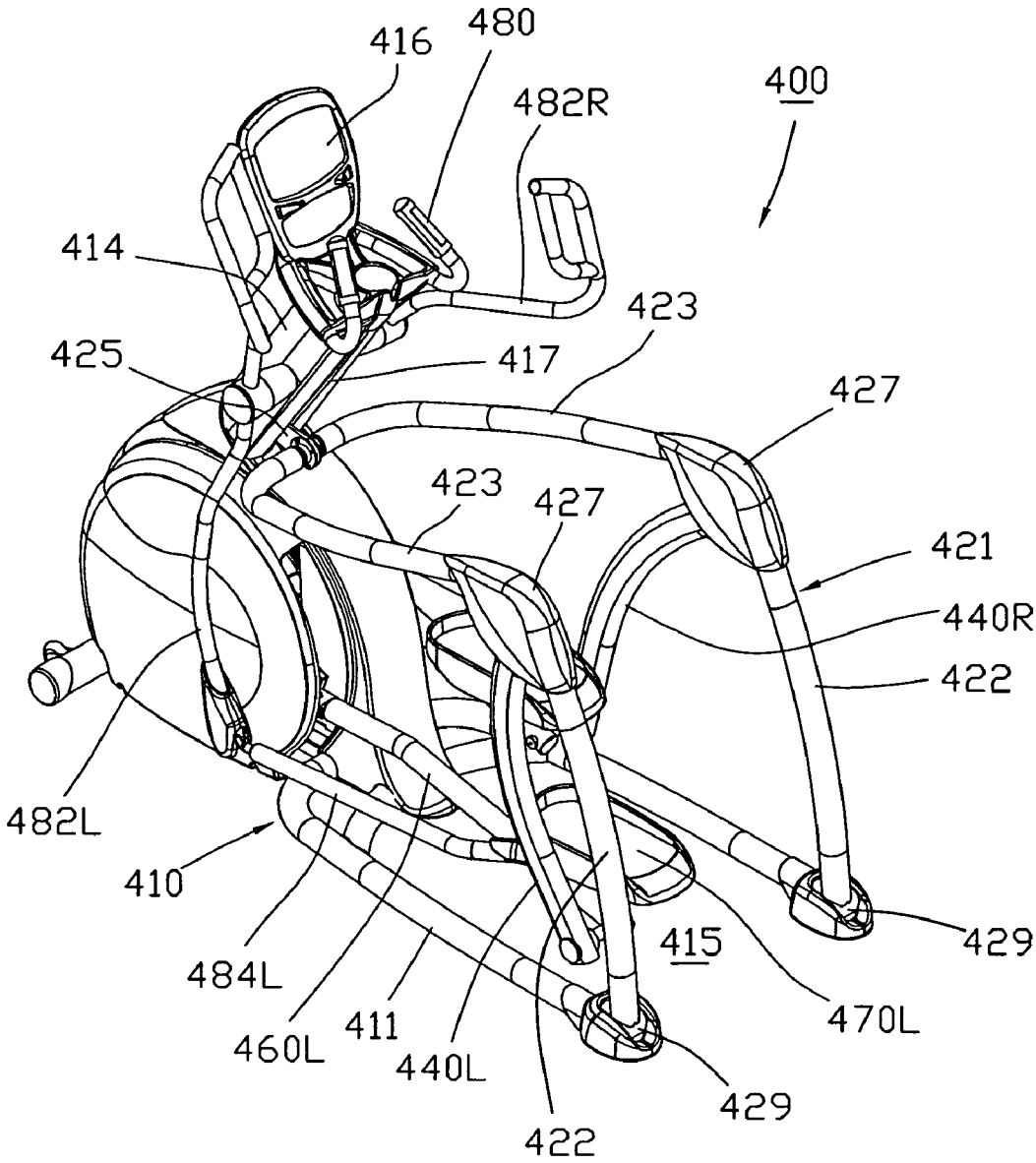
FIG. 17 is a perspective view of a fourth embodiment of a stationary exercise apparatus in accordance with the present invention.

As illustrated in FIG. 22, the first portions 423 from each side of the movable frame 421 are joined directly or indirectly to one another in a U-shape to define an exercise space 415 for a user. As used herein, "joined to" is defined as being integral with, joined directly to, or joined indirectly, either in a relatively fixed relationship or an operable relationship in which one component moves relative to another component. The first portion 423 and the second portion 422 on each side of the movable frame 421 are connected to each other by swing brackets 424. The first portion 423 is extended forward substantially from the upper end of the second portion 422 of the movable frame 421. In FIG. 17, for example, the swing brackets 424 are covered by covers 427 provided for a user to hold while exercising, and to cover any pinch points in the swing brackets 424.

Figure 21:
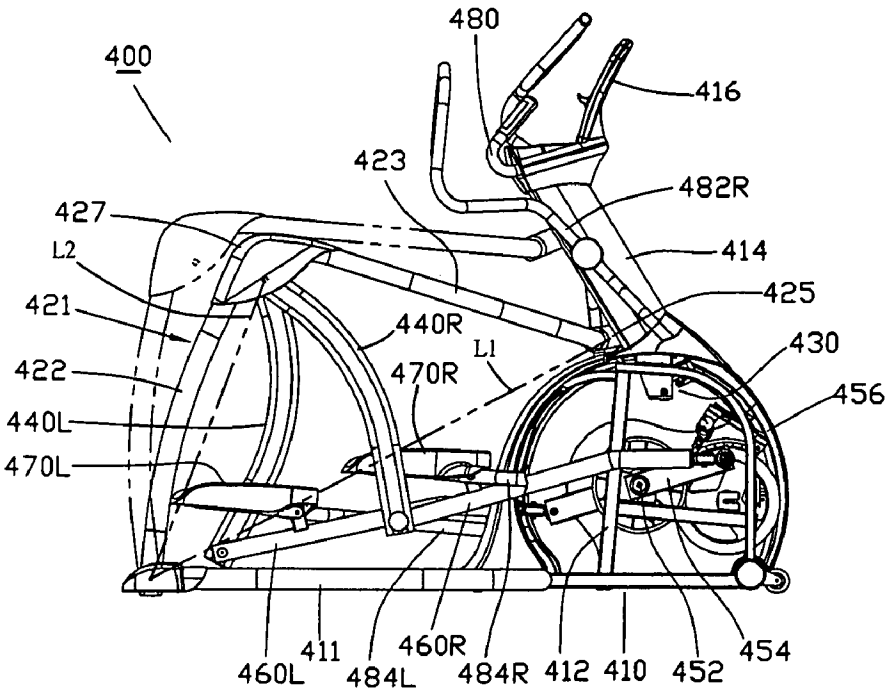
FIG. 21 is a right side view of FIG. 17 illustrating both a relatively low incline condition and a relatively high incline condition.

Referring to FIGS. 21 and 22, the pivot axis A is shown as the location where the movable frame 421 pivots with respect to the stationary frame 410. Near the opposite end of the movable frame 421 is the lifting member 425, where a driving assembly 430 lifts and lowers the movable frame 421. The entire movable frame 421 acts as a lever, with pivot axis A acting as the fulcrum. The weight of the user is substantially supported by the first and second supporting members 460L/460R and the first and second swing members 440L/440R, and the load goes through the first and second swing members 440L/440R and into the movable frame 421 at pivot axis B. A line drawn from the lifting member 425 to pivot axis A called L1, and another line drawn from pivot axis A to pivot axis B called L2, represent the lever arms for the forces at the lifting member 425 and pivot axis B, respectively. In this embodiment, the lever arm L1 is longer than the lever arm L2. The longer lever arm, L1, allows a relatively small force from the driving assembly 430 to lift the weight of the movable frame 421 and the user. More details and advantages of this lever will be discussed below.

Figure 23C:
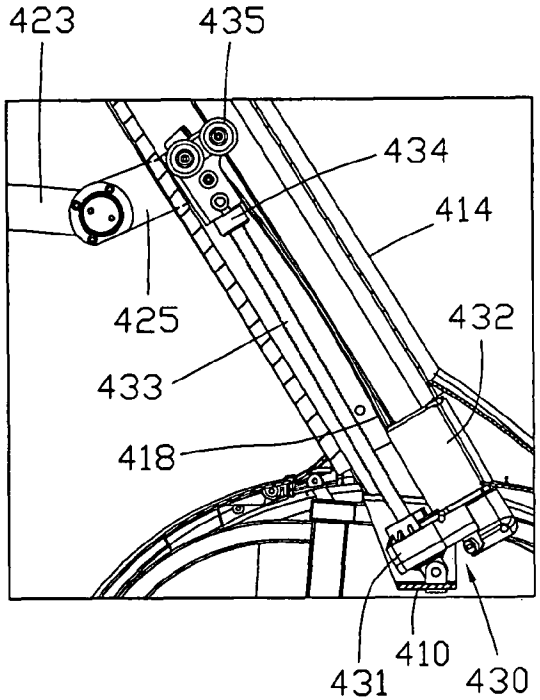
FIGS. 23A, 23B and 23C are cutaway views showing the operation of one possible incline mechanism for the embodiment of FIG. 17.
Figure 23B:
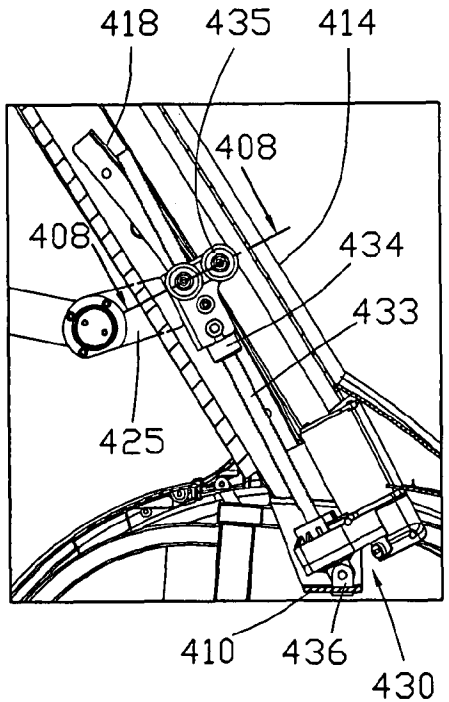
Figure 23A:
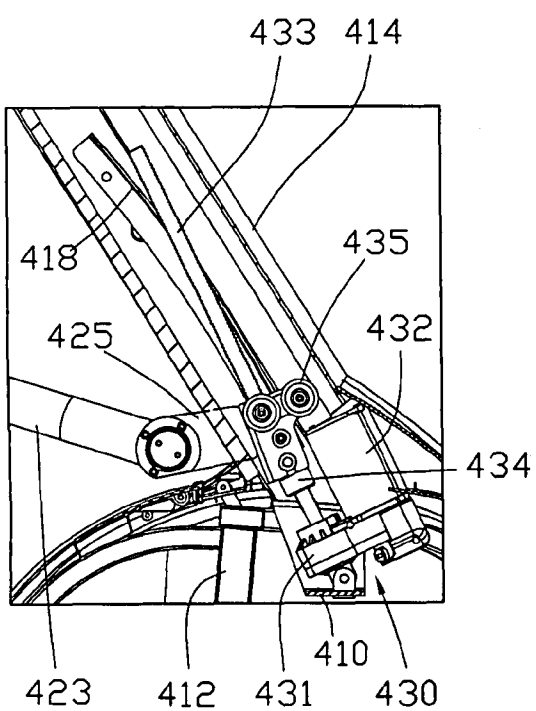
Figure 24:
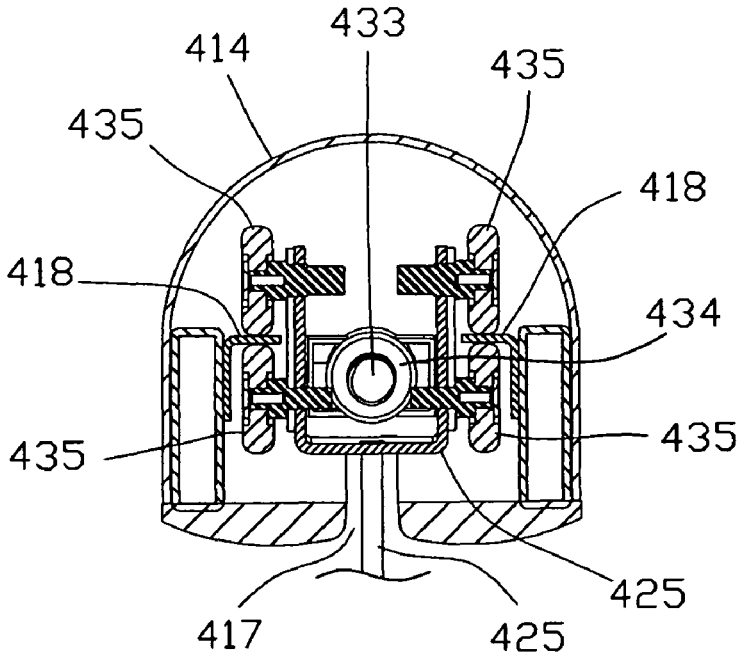
FIG. 24 is a cutaway view about the 408-408 axis of FIG. 23B.

Now referring to FIGS. 23 and 24, a driving assembly 430 is coupled to the stationary frame 410. The driving assembly 430 preferably comprises an actuator 431, a motor 432, a screw rod 433, and a threaded nut 434, but other driving assemblies could be used in the present invention. In a preferred embodiment of the present invention as shown in FIG. 23, the actuator 431 of the driving assembly 430 is located at the bottom of the standard 414, and is pivotally connected to the stationary frame 410. The screw rod 433 extends up inside the standard 414, and one end portion of the screw rod 433 of the driving assembly 430 is connected to the actuator 431, while the other end portion of screw rod 433 is free. The threaded nut 434 of the driving assembly 430 is engaged to the screw rod 433 of the driving assembly 430 and to the lifting member 425 of the movable frame 421. The motor 432 of the driving assembly 430 is coupled to the actuator 431, and a user can control the motor 432 with touch screens, buttons, dials, or other interactive components in the console 416. Therefore, a user can control the motor 432 from the console 416, causing the actuator 431 to rotate the screw rod 433 and causing the threaded nut 434 to move up or down the screw rod 433. This in turn causes the lifting member 425 to be moved up or down the standard 414. The screw rod 433 and nut 434 combination is preferred, but other "movable members" can be used within the scope of the present invention.

One advantage of this embodiment is that the large lever arm L1 provides a mechanical advantage to lift the weight of the movable frame 421 and the user. This mechanical advantage in turn allows a smaller motor 432 and actuator 431 to be used. A smaller motor 432 is potentially less expensive. Additionally, a smaller motor 432 fits into a smaller package which is important to allow the drive mechanism 430 to fit inside the standard 414. Another advantage of this embodiment is that the movable frame 421 can be raised and lowered using a single driving assembly 430. This can further reduce cost and complexity.

Figure 19:
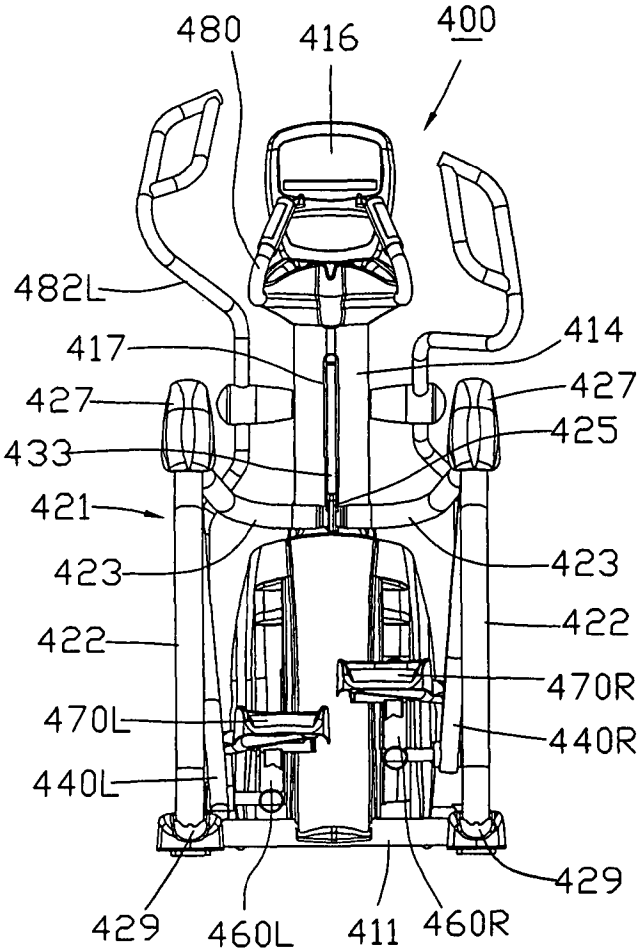
FIG. 19 is a back view of FIG. 17.

As seen in FIGS. 17 and 19, the standard 414 of the stationary frame 410 includes a slot 417 that preferably extends along the entire length of the standard 414. It is through this slot 417 that the lifting member 425 extends to be mounted on the threaded nut 434 of the driving assembly 430. As is mentioned earlier, rotation of the screw rod 433 by the motor 432 moves the threaded nut 434 along the length of the screw rod 433. Because the lifting member 425 is mounted to the threaded nut 434, the lifting member 425 also moves up or down the screw rod 434.

As stated above, the lifting member 425 extends through the slot 417 of the standard 414, and is connected to the movable frame 421. Therefore, actuation of the driving assembly 430 raises or lowers the lifting member 425 which in turn causes the movable frame 421 to rotate through pivots 429 about axis A. The first portions 423 are joined directly or indirectly by a rigid connection, so the entire movable frame 421 rotates about axis A as a single rigid unit. As the movable frame 421 pivots about the axis A, the lifting member 425 moves through an arcuate path. To accommodate this movement, the threaded nut 434 of the driving assembly 430, the screw rod 433 and the actuator 431 are pivotally connected to the stationary frame 410 at a pivot 436, and pivot during the lifting process as shown by the different angles of the screw rod shown in FIGS. 23A, 23B, and 23C.

Referring to FIGS. 23A and 23C, it can be seen that the lifting member 425 can be controlled to move between an upper and a lower point by the driving assembly 430. As the lifting member 425 moves down, the first portion 423 of the movable frame 421 will move forward and down. As the lifting member moves up, the first portion 423 of the movable frame 421 will move rearward and up. In other words, the driving assembly 430 moves the first portion 423 of the movable frame 421 between a foremost point (FIG. 23A) and a rearmost point (FIG. 23C).

To increase the stability of the driving assembly 430 and the movable frames 421, a preferred embodiment of the present invention is shown in FIG. 24, where guiders 418 are mounted on the inner surface of the standard 414 of the stationary frame 410. In a preferred embodiment, each of the guiders 418 is L-shaped in cross-section and is arc-shaped with a radius defined by the axis A. The lifting member 425 further includes rollers 435 rotatably connected therewith and positioned to have rolling contact on at least one side of the guiders 418, but in a preferred embodiment, rollers 435 sandwich the guiders 418 to provide stability and smooth operational motion.

This embodiment of the stationary exercise apparatus 400 is used to support first and second swing members 440L/440R. The first and second swing members 440L/440R are respectively pivotally connected to the movable frame 421 about a swing axis B as shown in FIG. 22, similar to the embodiment illustrated in FIGS. 1 to 6 and described above. Each of the swing members 440L/440R has an upper portion and a lower portion. The upper portions of the first and second swing members 440L/440R are pivotally connected to the movable frame 421. The lower portions of the first and second swing members 440L/440R swing through arc paths relative to the movable frame 421. When the movable frame 421 changes angles relative to the base 411 of the stationary frame 410, the upper portions of the first and second swing members 440L/440R move forward or backward with the movable frame 421.

The exercise apparatus 400, includes a horizontal first axis 452 in proximity to a post 412 of the stationary frame 410. Left and right cranks 454 rotate about the first axis 452, similar to those described and illustrated in relation to the first embodiment. A resistance member 456 is coupled to the stationary exercise apparatus 400 which can be controlled through the console 416 to adjust the rotating resistance of the left and right cranks 454.

Now referring to FIG. 21, the stationary exercise apparatus 400 also includes first and second supporting members 460L/460R. Each of the first and second supporting members 460L/460R has a first end portion and a second end portion. The first end portions are respectively joined to the left and right cranks 454 to rotate about a closed path about the first axis 452. The second end portions of the first and second supporting members 460L/460R are respectively pivotally connected to the lower portions of the first and second swing members 440L/440R for moving along a reciprocating path T1 as shown in FIG. 26. In the current embodiment, the swing axis B is positioned behind a middle point of the reciprocating path T1.

The stationary exercise apparatus 400 also includes first and second pedals 470L/470R. Each of the first and second pedals 470L/470R is respectively supported by the first and second supporting members 460L/460R proximate to the second end portions of the respective supporting members 406L/460R.

Figure 25:
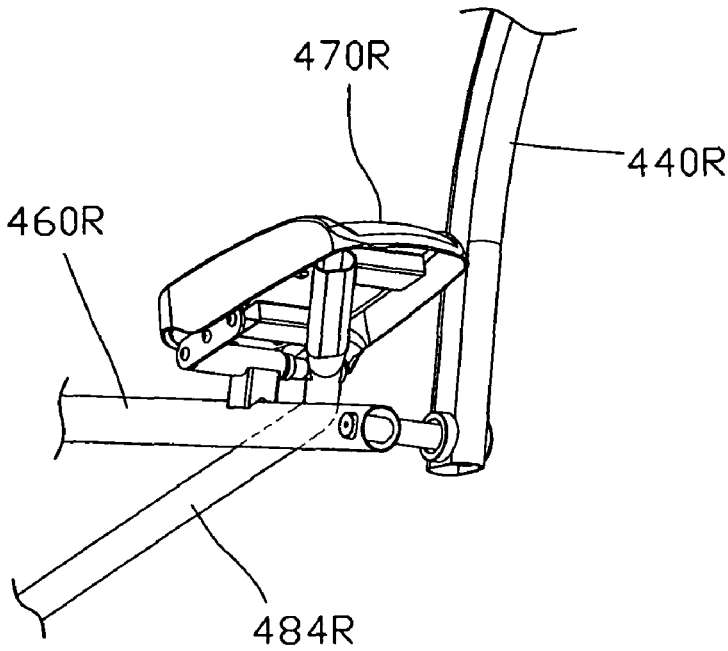
FIG. 25 is a perspective view of part of the pedals.

Referring to FIG. 25, the first and second pedals 470L/470R are pivotally connected to the respective first and second supporting members 460L/460R so that the rear portions of the first and second pedals 470L/470R move upwardly or downwardly about the pivots relative to the respective first and second supporting members 460L/460R. Referring to FIGS. 26*a-b* and FIGS. 27*a-b*, the motion of the first and second supporting members 460L/460R causes the first and second pedals 470L/470R to move along a closed-loop path 490.

Similar to the embodiments described above, the embodiment of FIGS. 17 and 25, also includes linkages including first and second handle links 482L/482R, and first and second control links 484L/484R. Each of the first and second handle links 482L/482R has an upper portion and lower portion. Each of the first and second control links 484L/484R has a first end portion and a second end portion. In the preferred embodiment of the present invention, the standard 414 of the stationary frame 410 is pivotally connected to the first and second handle links 482L/482R at a location that is between the upper and lower portions of the first and second handle links 482L/482R, such that the upper and lower portions of the first and second handle links 482L/482R can swing forward and backward as the first and second handle links 482L/482R pivot about the pivotal connection on the standard 414. Also, the lower portions of the first and second handle links 482L/482R are respectively pivotally connected to the first end portions of the first and second control links 484L/484R, such that as the first and second handle links 482L/482R pivot about their pivotal connection to the standard 414, the first and second handle links 482L/482R move in a forward and rearward direction. The second end portions of the first and second control links 484L/484R are connected to the respective first and second pedals 470L/470R, such that the first and second control links 484L/484R control the angular orientation of the respective first and second pedals 470L/470R, which are pivotally connected at the forward ends of the first and second pedals 470L/470R to the respective first and second supporting members 460L/460R. The first and second handle links 482L/482R, the first and second control links 484L/484R, the first and second pedals 470L/470R, the first and second supporting members 460L/460R, the left and right cranks 454, and the first and second swing members 440L/440R are all interconnected such that motion in one causes movement in all the rest, and the motion of the first and second pedals 470L/470R is constrained to follow a closed-loop path 490 that is preferably substantially elliptical in shape.

A similar closed-loop path 490 for the first and second pedals 470L/470R may be attained with alternative machine geometry. For example, the first and second pedals 470L/470R may be directly supported by the respective first and second supporting members 460L/460R, or the first and second pedals 470L/470R may be directly supported by the respective first and second control links 484L/484R, and thereby indirectly supported by the respective first and second supporting members 460L/460R.

Figure 18:
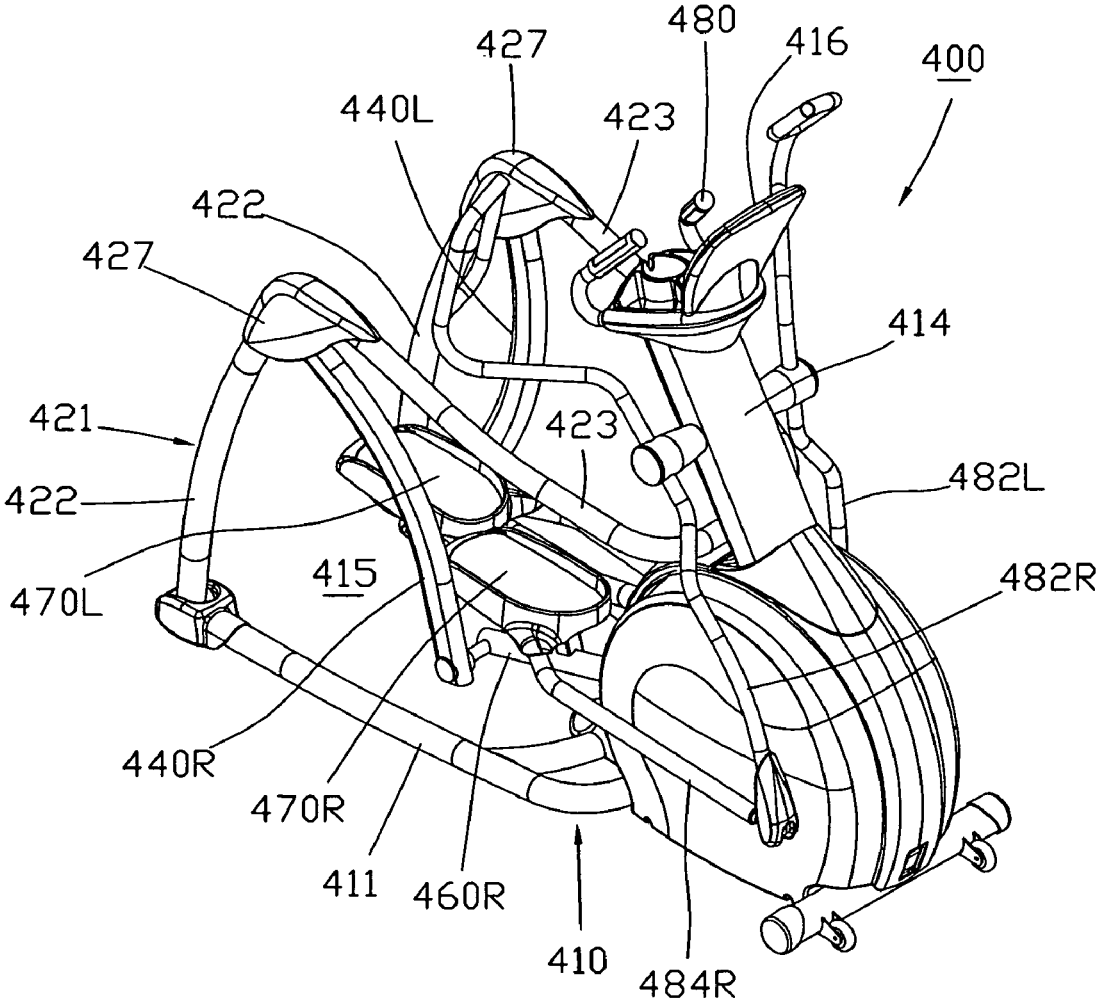
FIG. 18 is another perspective view of FIG. 17.
Figure 20:
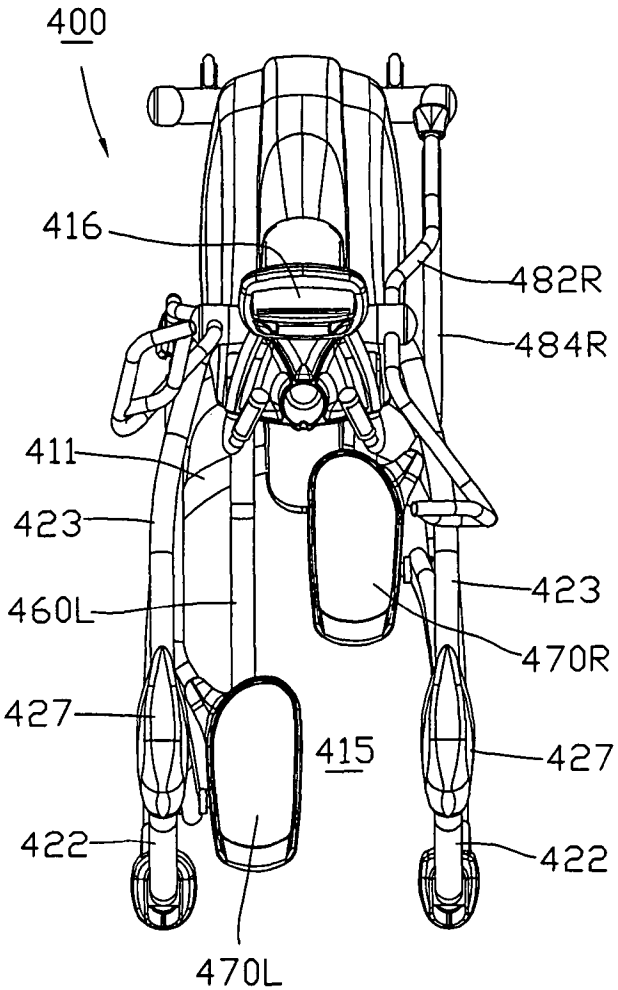
FIG. 20 is a top view of FIG. 17.
Figure 26A:
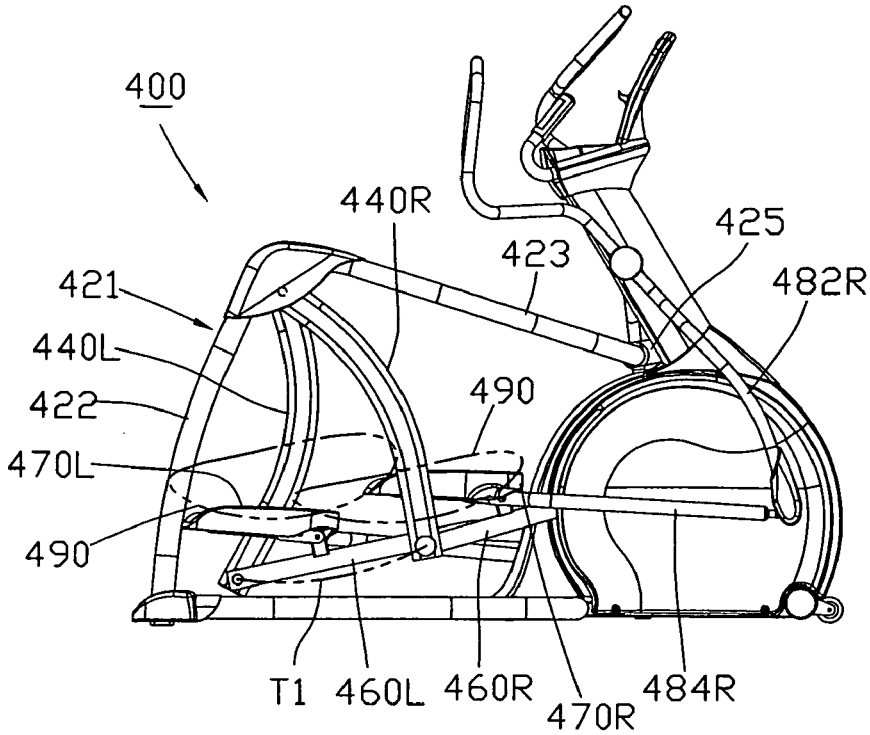
FIGS. 26A and 26B are right side views showing two different rotating positions of the fourth embodiment in a relatively low incline condition.
Figure 26B:
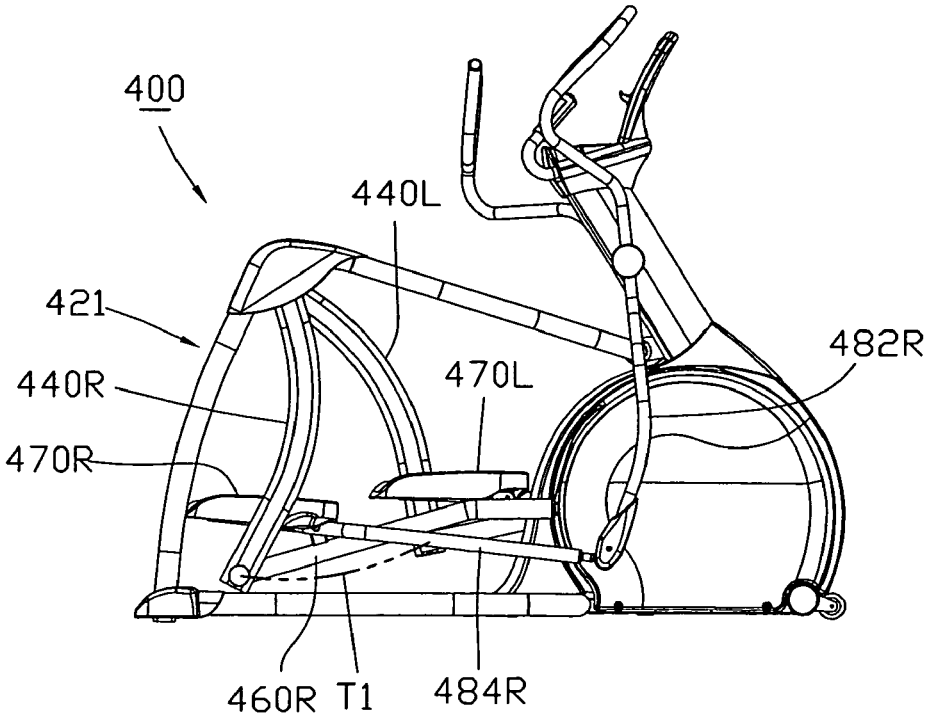
Figure 27A:
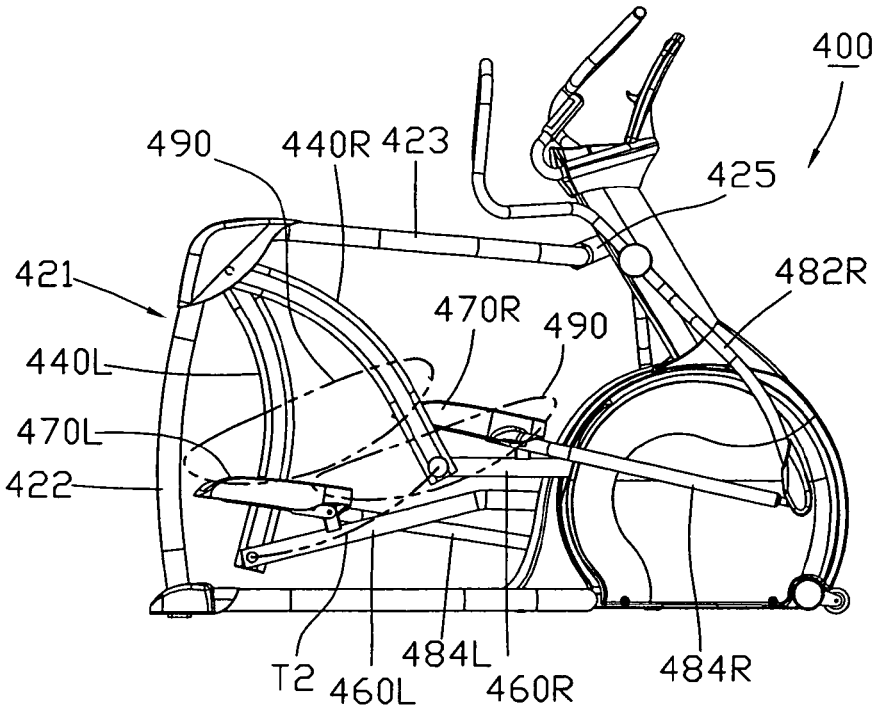
FIGS. 27A and 27B are right side views showing two different rotating positions of the fourth embodiment in a relatively high incline condition.
Figure 27B:
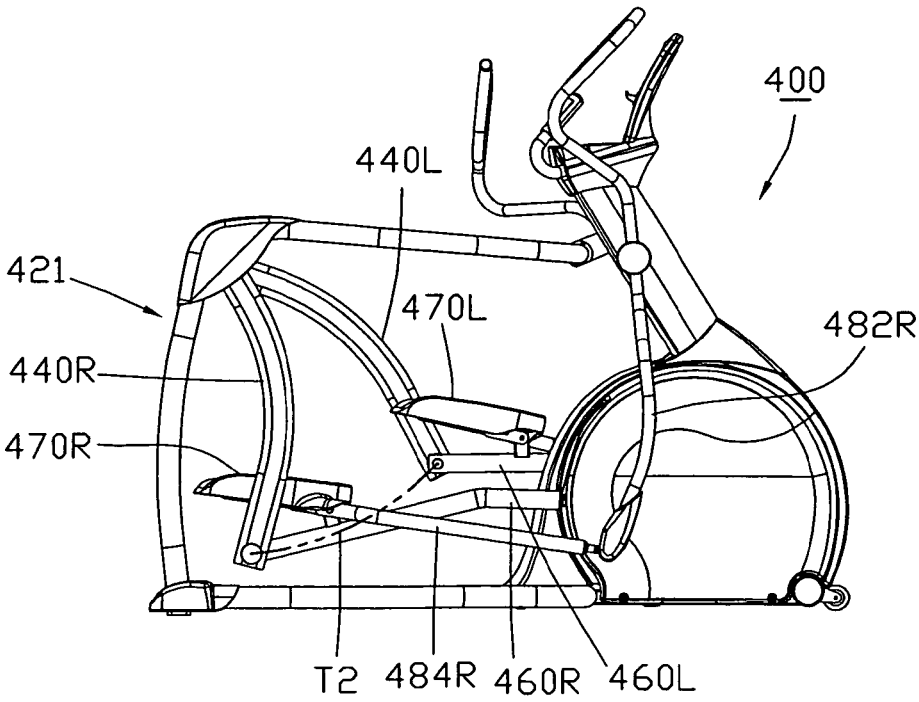

The method for operating the stationary exercise apparatus 400 is similar to the embodiments illustrated previously. One difference between this fourth embodiment and those described above is the method of adjusting the swing axis B. In the earlier embodiments, for example referring to FIG. 1, the first and second moving members 142 could be moved independently from one another, thereby positioning the upper portions of the left and right swing members 149*a*/149*b* so that they pivot along two separate axes. Referring to FIG. 22, the movable frame 421 is substantially rigid, moving as a unit, so that the upper portions of the left and right swing members 440L/440R stay in alignment as they pivot along a single axis B. When the movable frame 421 is positioned at the minimum angle such as illustrated in FIGS. 26A and 26B, the swing axis B is at the foremost point, and the reciprocating path T1 of the lower portions of the first and second swing members 440L/440R are in a lower incline level. Referring to FIGS. 18, 27A and 27B, when the movable frame 421 is positioned at the maximum angle such as illustrated in FIGS. 27A and 27B, the swing axis B is at the rearmost point, and the reciprocating path T2 of the lower portions of the first and second swing members 440L/440R are in a higher incline level. When adjusted between the lower incline level and the higher incline level, the stationary exercise apparatus 400 enhances the exercise intensity of a user.

Besides the adjustable paths of the first and second pedals 470L/470R, the described embodiment of the present invention has many advantages, including, but not limited to the movable frame 421 acts as a lever, providing mechanical advantage to the driving assembly 430 to more easily raise and lower the movable frame 421. At one end of the movable frame 421 is the lifting member 425, and at the other end of the movable frame 421 is the pivot axis A, where the movable frame 421 is pivotally connected to the base 411 of the stationary frame 410. In the middle portion of the movable frame 421 is a second pivot axis B, where the first and second swing members 440L/440R are pivotally connected to the movable frame 421. This movable frame 421 acts like a lever, allowing the use of a smaller and more efficient motor 432 in the driving assembly 430 to reposition the swing members 440L/440R and to set the angle of incline for the stationary exercise apparatus 400.

Another advantage is the rigid movable frame 421 that is moved by a single, centrally located driving assembly 430, so that the stationary exercise apparatus 400 is very stable and durable due to the balanced loading of the stationary exercise apparatus. Thus, when a user steps on the first and second pedals 470L/470R, the rigid movable frame 421 can better balance the weight of a user by spreading the load between each side of the movable frame 421 to add stability to the machine and reduce the offset loads which might require a larger support structure.

Referring to FIGS. 23A, 23B, and 23C, another advantage of the preferred embodiment of the present invention is depicted. Here, the single driving assembly 430 is enclosed within the standard 414 and is coupled to the stationary frame 410, to reduce the overall volume and footprint of the stationary exercise apparatus 400.

Also, in the fourth embodiment, a user can directly and quickly observe the level of incline of the first and second pedals 470L/470R by observing the position of the lifting member 425. Another advantage is that the substantially rigid U-shaped movable frame 421 allows the user easy access to mount and dismount the stationary exercise apparatus 400, while providing a wrap-around handrail to allow the user to feel comfortable and safe.

It is noted that instead of using only one lifting member 425 and one drive assembly 430 to raise or lower a single movable frame 421, the movable frame 421 could be split into two movable frames 421, with two independent lifting members 425 and two independent drive assemblies 430 to independently adjust the incline of the closed-loop path 490 of the first and second pedals 470L/470R, and still be within the scope of the present invention.

The present invention does not require that all the advantageous features and all the advantages described need to be incorporated into every embodiment thereof. Although the present invention has been described in considerable detail with reference to certain preferred embodiments thereof, other embodiments are possible. Therefore, the spirit and scope of the appended claims should not be limited to the description of the preferred embodiment contained herein.

The invention claimed is:

1. A stationary exercise apparatus, comprising:

a frame having a base, a front portion and back portion;

a standard joined to and extending upwardly from the front portion of the frame, and having an upper portion spaced apart from the base;

a rail joined to the upper portion of the standard and to the back portion of the frame;

first and second supporting members, each supporting member having a first end portion and a second end portion, the first end portions of the first and second supporting members respectively coupled to the frame to rotate about a first axis;

first and second swing members, each swing member having an upper portion and a lower portion, the lower portions of the first and second swing members respectively pivotally joined to the second end portions of the first and second supporting members, the upper portions of the first and second swing members respectively pivotally connected to the rail at positions that define a laterally extending swing axis therebetween;

first and second control links respectively pivotally connected to the first and second supporting members, each control link having a first end portion, a second end portion, and a central portion, wherein the first end portions of the first and second control links are movably coupled to the frame, the central portions of the first and second control links are respectively joined to the first and second supporting members so that the second end portion of each control link extends upwardly above the supporting members; and first and second pedals respectively coupled to the second end portions of the first and second control links, the first and second pedals are disposed between the standard and the back portion of the frame for movement along a closed path while the first ends of the first and second supporting members are being rotated about the first axis and the second ends of the first and second supporting members are reciprocating with the lower portions of the first and second swing members.

2. The stationary exercise apparatus of claim 1, and further comprising a resistance member joined to the front of the frame and operably engaged with the first and second supporting members.

3. The stationary exercise apparatus of claim 1, wherein the swing axis is positioned closer to the back of the frame than to the front of the frame.

4. The stationary exercise apparatus of claim 1, wherein the second end portions of the first and second supporting members define a reciprocating path having a front end, a middle point, and a rear end, and the swing axis is positioned closer to the middle point of the reciprocating path than to the front of the frame.

5. The stationary exercise apparatus of claim 1, wherein the rail includes a substantially U-shaped portion to define an exercise space for a user.

6. The stationary exercise apparatus of claim 1, wherein the rail is pivotally joined to the base of the frame.

7. The stationary exercise apparatus of claim 6, and further comprising a driving assembly coupled to the standard and joined to the rail.

8. The stationary exercise apparatus of claim 7, wherein the driving assembly further comprises:

a motor;

a screw rod joined to the motor; and a threaded nut joined to the screw rod and to the rail.

9. A stationary exercise apparatus, comprising:

a frame having a base, a front portion and back portion;

a rail joined to the front portion of the frame and to the back portion of the frame;

first and second swing members, each of the swing members having an upper portion and a lower portion, the upper portions of the first and second swing members respectively pivotally connected to the rail at positions that define a laterally extending swing axis therebetween;

first and second supporting members, each supporting member having a first end portion and a second end portion, the first end portions of the first and second supporting members respectively joined to the frame to rotate about a closed path, the second end portions of the first and second supporting members respectively pivotally connected to the lower portions of the first and second swing members;

first and second control links respectively connected to the first and second supporting members, each control link having a first end portion, a second end portion, and a central portion, wherein the first end portions of the first and second control links are movably coupled to the frame, the central portions of the first and second control links are respectively joined to the first and second supporting members so that the second portion of each control link extends above the supporting members to support the first and second pedals;

a resistance member joined to the front portion of the frame and operably engaged with the first and second supporting members; and first and second pedals, each of the pedals supported by the respective first and second supporting members.

10. The stationary exercise apparatus of claim 9, wherein the rail is pivotally joined to the back portion of the frame.

11. The stationary exercise apparatus of claim 10, further comprising a driving assembly operatively joined to the rail to pivot the rail and move the swing axis between the frame front portion and the frame rear portion.

12. The stationary exercise apparatus of claim 9, and further comprising:

a mast joined to and extending upward from the frame front portion and to the rail and the mast includes an upper portion joined to the rail.

13. The stationary exercise apparatus of claim 9, wherein the second end portions of the first and second supporting members define a reciprocating path having a front end, a middle point, and a rear end and the swing axis is positioned farther from the front portion of the frame than the middle point of the reciprocating path.

* * * * *